US009506009B2

(12) United States Patent
Dance et al.

(10) Patent No.: US 9,506,009 B2
(45) Date of Patent: Nov. 29, 2016

(54) LUBRICATING OIL COMPOSITIONS WITH ENGINE WEAR PROTECTION

(71) Applicants: Smruti A. Dance, Robbinsville, NJ (US); Ahmed F. Abou El Enein, Philadelphia, PA (US); Benjamin D. Eirich, Wenonah, NJ (US); Kevin J. Kelly, Mullica Hill, NJ (US); Douglas E. Deckman, Mullica Hill, NJ (US)

(72) Inventors: Smruti A. Dance, Robbinsville, NJ (US); Ahmed F. Abou El Enein, Philadelphia, PA (US); Benjamin D. Eirich, Wenonah, NJ (US); Kevin J. Kelly, Mullica Hill, NJ (US); Douglas E. Deckman, Mullica Hill, NJ (US)

(73) Assignee: ExxonMobil Research and Engineering Company, Annondale, NJ (US)

( * ) Notice: Subject to any disclaimer, the term of this patent is extended or adjusted under 35 U.S.C. 154(b) by 181 days.

(21) Appl. No.: 14/289,891

(22) Filed: May 29, 2014

(65) Prior Publication Data

US 2015/0344805 A1 Dec. 3, 2015

(51) Int. Cl.
*C10M 133/56* (2006.01)
*C10M 143/10* (2006.01)
(Continued)

(52) U.S. Cl.
CPC ..... *C10M 157/04* (2013.01); *C10M 161/00* (2013.01); *C10M 133/44* (2013.01); *C10M 143/10* (2013.01); *C10M 2205/04* (2013.01); *C10M 2207/262* (2013.01); *C10M 2207/34* (2013.01); *C10M 2215/223* (2013.01); *C10M 2215/28* (2013.01); *C10M 2219/046* (2013.01); *C10N 2220/021* (2013.01); *C10N 2220/029* (2013.01); *C10N 2230/02* (2013.01); *C10N 2230/04* (2013.01); *C10N 2230/041* (2013.01);
(Continued)

(58) Field of Classification Search
CPC ..... C10M 2205/066; C10M 2215/28
USPC ..... 508/293, 591
See application file for complete search history.

(56) References Cited

U.S. PATENT DOCUMENTS 344,170 A 6/1886 Delmage
1,815,022 A 7/1931 Davis
(Continued)

FOREIGN PATENT DOCUMENTS

CA 1094044 A1 1/1981
CN 102229846 B 9/2013
(Continued)

OTHER PUBLICATIONS

The International Search Report and Written Opinion of PCT/US2015/028174 dated Jul. 9, 2015.
(Continued)

*Primary Examiner* — Vishal Vasisth
(74) *Attorney, Agent, or Firm* — Robert A. Migliorini

(57) ABSTRACT

A method for improving wear control, while maintaining or improving deposit control and fuel efficiency, in an engine lubricated with a lubricating oil by using as the lubricating oil a formulated oil. The formulated oil has a composition including a lubricating oil base stock as a major component, and at least one dispersant and a mixture of viscosity modifiers, as minor components. The at least one dispersant is a polyalkenyl succinic derivative and at least one viscosity modifier is a vinyl aromatic-containing polymer or copolymer. A lubricating engine oil having a composition including a lubricating oil base stock as a major component, at least one dispersant and a mixture of viscosity modifiers, as minor components. The lubricating engine oils are useful in internal combustion engines including direct injection, gasoline and diesel engines.

33 Claims, 54 Drawing Sheets

| Comparative Examples | Comp. Ex. A | Comp. Ex. B | Comp. Ex. C |
|---|---|---|---|
| Group III | 46.00 | 45.50 | 45.50 |
| Group IV | 24.46 | 25.55 | 25.55 |
| Group V - Ester | 5.00 | 5.00 | 0.00 |
| Group V - Alkylated Naphthalene | 0.00 | 0.00 | 5.00 |
| Dispersant 1 - carboxylate-capped PIBSA | 5.20 | 0.00 | 0.00 |
| Dispersant 2 - uncapped PIBSA | 0.00 | 4.33 | 4.33 |
| Detergent 1 - metal salicylate or mixtures | 3.00 | 2.35 | 2.35 |
| Detergent 2 - metal sulfonate or mixtures | 0.00 | 0.00 | 0.00 |
| Viscosity Modifier 1 - diblock olefin copolymer | 5.00 | 5.00 | 5.00 |
| Viscosity Modifier 2 - star olefin copolymer | 5.50 | 5.50 | 5.50 |
| Viscosity Modifier 3 - star olefin copolymer | 0.00 | 0.00 | 0.00 |
| Viscosity Modifier 4 - polymethacrylate | 0.00 | 0.00 | 0.00 |
| Additive Package | 5.84 | 6.77 | 6.77 |
| TOTAL | 100.00 | 100 | 100 |

(51) Int. Cl.
*C10M 157/04* (2006.01)
*C10M 161/00* (2006.01)
*C10M 133/44* (2006.01)

(52) U.S. Cl.
CPC ..... *C10N 2230/06* (2013.01); *C10N 2230/54* (2013.01); *C10N 2240/10* (2013.01); *C10N 2240/103* (2013.01); *C10N 2240/104* (2013.01)

(56) References Cited

U.S. PATENT DOCUMENTS

| | | | |
|---|---|---|---|
| 2,015,748 | A | 10/1935 | Frolich |
| 2,100,993 | A | 11/1937 | Bruson |
| 2,191,498 | A | 2/1940 | Reiff |
| 2,387,501 | A | 10/1945 | Dietrich |
| 2,655,479 | A | 10/1953 | Munday et al. |
| 2,666,746 | A | 1/1954 | Munday |
| 2,721,877 | A | 10/1955 | Popkin |
| 2,721,878 | A | 10/1955 | Popkin |
| 2,817,693 | A | 12/1957 | Koome et al. |
| 3,036,003 | A | 5/1962 | Verdol |
| 3,087,936 | A | 4/1963 | Le Suer |
| 3,172,892 | A | 3/1965 | Le Suer et al. |
| 3,200,107 | A | 8/1965 | Le Suer |
| 3,215,707 | A | 11/1965 | Rense |
| 3,219,666 | A | 11/1965 | Norman et al. |
| 3,250,715 | A | 5/1966 | Wyman |
| 3,254,025 | A | 5/1966 | Le Suer |
| 3,272,746 | A | 9/1966 | Le Suer et al. |
| 3,275,554 | A | 9/1966 | Wagenaar |
| 3,316,177 | A | 4/1967 | Dorer, Jr. |
| 3,322,670 | A | 5/1967 | Burt et al. |
| 3,329,658 | A | 7/1967 | Fields |
| 3,341,542 | A | 9/1967 | Le Suer et al. |
| 3,382,291 | A | 5/1968 | Brennan |
| 3,413,347 | A | 11/1968 | Worrel |
| 3,438,757 | A | 4/1969 | Honnen et al. |
| 3,449,250 | A | 6/1969 | Fields |
| 3,454,555 | A | 7/1969 | van der Voort et al. |
| 3,454,607 | A | 7/1969 | Le Suer et al. |
| 3,519,565 | A | 7/1970 | Coleman |
| 3,541,012 | A | 11/1970 | Stuebe |
| 3,565,804 | A | 2/1971 | Honnen et al. |
| 3,595,791 | A | 7/1971 | Cohen |
| 3,630,904 | A | 12/1971 | Musser et al. |
| 3,632,511 | A | 1/1972 | Liao |
| 3,652,616 | A | 3/1972 | Brannen, Jr. et al. |
| 3,666,730 | A | 5/1972 | Coleman |
| 3,687,849 | A | 8/1972 | Abbott |
| 3,697,574 | A | 10/1972 | Piasek et al. |
| 3,702,300 | A | 11/1972 | Coleman |
| 3,703,536 | A | 11/1972 | Piasek et al. |
| 3,704,308 | A | 11/1972 | Piasek et al. |
| 3,725,277 | A | 4/1973 | Worrel |
| 3,725,480 | A | 4/1973 | Traise et al. |
| 3,726,882 | A | 4/1973 | Traise et al. |
| 3,742,082 | A | 6/1973 | Brennan |
| 3,751,365 | A | 8/1973 | Piasek et al. |
| 3,755,433 | A | 8/1973 | Miller et al. |
| 3,756,953 | A | 9/1973 | Piasek et al. |
| 3,769,363 | A | 10/1973 | Brennan |
| 3,787,374 | A | 1/1974 | Adams |
| 3,798,165 | A | 3/1974 | Piasek et al. |
| 3,803,039 | A | 4/1974 | Piasek et al. |
| 3,822,209 | A | 7/1974 | Knapp et al. |
| 3,876,720 | A | 4/1975 | Heilman et al. |
| 3,948,800 | A | 4/1976 | Meinhardt |
| 4,100,082 | A | 7/1978 | Clason et al. |
| 4,149,178 | A | 4/1979 | Estes |
| 4,218,330 | A | 8/1980 | Shubkin |
| 4,234,435 | A | 11/1980 | Meinhardt et al. |
| 4,239,930 | A | 12/1980 | Allphin et al. |
| 4,367,352 | A | 1/1983 | Watts, Jr. et al. |
| 4,413,156 | A | 11/1983 | Watts, Jr. et al. |
| 4,426,305 | A | 1/1984 | Malec |
| 4,434,408 | A | 2/1984 | Baba et al. |
| 4,454,059 | A | 6/1984 | Pindar et al. |
| 4,594,172 | A | 6/1986 | Sie |
| 4,767,551 | A | 8/1988 | Hunt et al. |
| 4,798,684 | A | 1/1989 | Salomon |
| 4,827,064 | A | 5/1989 | Wu |
| 4,827,073 | A | 5/1989 | Wu |
| 4,897,178 | A | 1/1990 | Best et al. |
| 4,910,355 | A | 3/1990 | Shubkin et al. |
| 4,921,594 | A | 5/1990 | Miller |
| 4,943,672 | A | 7/1990 | Hamner et al. |
| 4,952,328 | A | 8/1990 | Davis et al. |
| 4,952,739 | A | 8/1990 | Chen |
| 4,956,122 | A | 9/1990 | Watts et al. |
| 4,975,177 | A | 12/1990 | Garwood et al. |
| 5,068,487 | A | 11/1991 | Theriot |
| 5,075,269 | A | 12/1991 | Degnan et al. |
| 5,084,197 | A | 1/1992 | Galic et al. |
| 5,430,105 | A | 7/1995 | Redpath et al. |
| 5,705,458 | A | 1/1998 | Roby et al. |
| 6,034,039 | A | 3/2000 | Gomes et al. |
| 6,080,301 | A | 6/2000 | Berlowitz et al. |
| 6,090,989 | A | 7/2000 | Trewella et al. |
| 6,165,949 | A | 12/2000 | Berlowitz et al. |
| 6,323,164 | B1 | 11/2001 | Liesen et al. |
| 7,687,445 | B2 | 3/2010 | Rosenbaum et al. |
| 7,704,930 | B2 | 4/2010 | Deckman et al. |
| 7,867,955 | B2 | 1/2011 | Conroy et al. |
| 8,048,833 | B2 | 11/2011 | Habeeb et al. |
| 2007/0099802 | A1 | 5/2007 | Scott |
| 2008/0020950 | A1 | 1/2008 | Gray et al. |
| 2009/0291871 | A1* | 11/2009 | Chu ..... C10M 143/00 508/539 |
| 2010/0093578 | A1 | 4/2010 | Tsujimoto et al. |

FOREIGN PATENT DOCUMENTS

| | | | |
|---|---|---|---|
| EP | 0471071 | B1 | 2/1991 |
| EP | 0464546 | A1 | 8/1992 |
| EP | 0464547 | A1 | 8/1992 |
| GB | 1350257 | A | 4/1974 |
| GB | 1390359 | A | 4/1975 |
| GB | 1429494 | A | 3/1976 |
| GB | 1440230 | A | 6/1976 |
| WO | 2013003406 | A1 | 3/2013 |

OTHER PUBLICATIONS

Goldmints et al., "Lubricant Viscometric Profile for Optimal Fuel Economy and Wear Performance," World Tribology Congress, 2009, Kyoto, Japan.

* cited by examiner

Fig. 1

| Comparative Examples | Comp. Ex. A | Comp. Ex. B | Comp. Ex. C |
|---|---|---|---|
| Group III | 46.00 | 45.50 | 45.50 |
| Group IV | 24.46 | 25.55 | 25.55 |
| Group V - Ester | 5.00 | 5.00 | 0.00 |
| Group V - Alkylated Naphthalene | 0.00 | 0.00 | 5.00 |
| Dispersant 1 - carboxylate-capped PIBSA | 5.20 | 0.00 | 0.00 |
| Dispersant 2 - uncapped PIBSA | 0.00 | 4.33 | 4.33 |
| Detergent 1 - metal salicylate or mixtures | 3.00 | 2.35 | 2.35 |
| Detergent 2 - metal sulfonate or mixtures | 0.00 | 0.00 | 0.00 |
| Viscosity Modifier 1 - diblock olefin copolymer | 5.00 | 5.00 | 5.00 |
| Viscosity Modifier 2 - star olefin copolymer | 5.50 | 5.50 | 5.50 |
| Viscosity Modifier 3 - star olefin copolymer | 0.00 | 0.00 | 0.00 |
| Viscosity Modifier 4 - polymethacrylate | 0.00 | 0.00 | 0.00 |
| Additive Package | 5.84 | 6.77 | 6.77 |
| TOTAL | 100.00 | 100 | 100 |

Fig. 1 (Cont.)

| Comparative Examples | Comp. Ex. D | Comp. Ex. E | Comp. Ex. F |
|---|---|---|---|
| Group III | 48.50 | 48.36 | 45.50 |
| Group IV | 27.70 | 27.50 | 32.00 |
| Group V - Ester | 0.00 | 0.00 | 0.00 |
| Group V - Alkylated Naphthalene | 0.00 | 0.00 | 0.00 |
| Dispersant 1 - carboxylate-capped PIBSA | 0.00 | 0.00 | 0.00 |
| Dispersant 2 - uncapped PIBSA | 4.33 | 5.00 | 4.33 |
| Detergent 1 - metal salicylate or mixtures | 2.35 | 2.35 | 0.00 |
| Detergent 2 - metal sulfonate or mixtures | 0.00 | 0.00 | 1.95 |
| Viscosity Modifier 1 - diblock olefin copolymer | 5.00 | 5.00 | 5.50 |
| Viscosity Modifier 2 - star olefin copolymer | 5.50 | 5.50 | 4.10 |
| Viscosity Modifier 3 - star olefin copolymer | 0.00 | 0.00 | 0.00 |
| Viscosity Modifier 4 - polymethacrylate | 0.00 | 0.00 | 0.00 |
| Additive Package | 6.62 | 6.29 | 6.62 |
| TOTAL | 100 | 100 | 100 |

Fig. 1 (Cont.)

| Comparative Examples | Comp. Ex. G | Comp. Ex. H | Comp. Ex. I |
|---|---|---|---|
| Group III | 45.67 | 45.71 | 46.00 |
| Group IV | 26.10 | 25.00 | 25.51 |
| Group V - Ester | 5.00 | 5.00 | 5.00 |
| Group V - Alkylated Naphthalene | 0.00 | 0.00 | 0.00 |
| Dispersant 1 - carboxylate-capped PIBSA | 0.00 | 0.00 | 5.20 |
| Dispersant 2 - uncapped PIBSA | 4.33 | 5.00 | 0.00 |
| Detergent 1 - metal salicylate or mixtures | 1.63 | 2.35 | 0.00 |
| Detergent 2 - metal sulfonate or mixtures | 0.00 | 0.00 | 1.95 |
| Viscosity Modifier 1 - diblock olefin copolymer | 5.00 | 5.00 | 5.00 |
| Viscosity Modifier 2 - star olefin copolymer | 5.50 | 5.50 | 5.50 |
| Viscosity Modifier 3 - star olefin copolymer | 0.00 | 0.00 | 0.00 |
| Viscosity Modifier 4 - polymethacrylate | 0.00 | 0.00 | 0.00 |
| Additive Package | 6.77 | 6.44 | 5.84 |
| TOTAL | 100.00 | 100.00 | 100.00 |

Fig. 2

| Examples | Ex. 1 | Ex. 2 | Ex. 3 |
|---|---|---|---|
| Group III | 46.00 | 47.00 | 47.25 |
| Group IV | 19.04 | 29.45 | 30.00 |
| Group V - Ester | 5.00 | 0.00 | 0.00 |
| Group V - Alkylated Naphthalene | 0.00 | 0.00 | 0.00 |
| Dispersant 1 - carboxylate-capped PIBSA | 5.20 | 0.00 | 0.00 |
| Dispersant 2 - uncapped PIBSA | 0.00 | 4.33 | 4.33 |
| Detergent 1 - metal salicylate or mixtures | 3.00 | 0.00 | 2.35 |
| Detergent 2 - metal sulfonate or mixtures | 0.00 | 1.95 | 0.00 |
| Viscosity Modifier 1 - diblock olefin copolymer | 6.42 | 5.00 | 4.20 |
| Viscosity Modifier 2 - star olefin copolymer | 0.00 | 5.50 | 4.50 |
| Viscosity Modifier 3 - star olefin copolymer | 9.50 | 0.00 | 0.00 |
| Viscosity Modifier 4 - polymethacrylate | 0.00 | 0.00 | 0.90 |
| Additive Package | 5.84 | 6.77 | 6.47 |
| TOTAL | 100 | 100 | 100 |

Fig. 2 (Cont.)

| Examples | Ex. 4 | Ex. 5 | Ex. 6 |
|---|---|---|---|
| Group III | 30.73 | 41.37 | 46.00 |
| Group IV | 34.00 | 23.36 | 19.91 |
| Group V - Ester | 5.40 | 5.40 | 5.00 |
| Group V - Alkylated Naphthalene | 0.00 | 0.00 | 0.00 |
| Dispersant 1 - carboxylate-capped PIBSA | 0.00 | 0.00 | 0.00 |
| Dispersant 2 - uncapped PIBSA | 4.33 | 4.33 | 4.33 |
| Detergent 1 - metal salicylate or mixtures | 3.00 | 3.00 | 3.00 |
| Detergent 2 - metal sulfonate or mixtures | 0.00 | 0.00 | 0.00 |
| Viscosity Modifier 1 - diblock olefin copolymer | 6.42 | 6.42 | 6.42 |
| Viscosity Modifier 2 - star olefin copolymer | 0.00 | 0.00 | 0.00 |
| Viscosity Modifier 3 - star olefin copolymer | 9.50 | 9.50 | 9.50 |
| Viscosity Modifier 4 - polymethacrylate | 0.00 | 0.00 | 0.00 |
| Additive Package | 6.62 | 6.62 | 5.84 |
| TOTAL | 100 | 100 | 100 |

Fig. 2 (Cont.)

| Examples | Ex. 7 | Ex. 8 | Ex. 9 |
|---|---|---|---|
| Group III | 30.41 | 54.05 | 46.00 |
| Group IV | 45.00 | 20.00 | 25.56 |
| Group V - Ester | 5.00 | 5.40 | 5.00 |
| Group V - Alkylated Naphthalene | 0.00 | 0.00 | 0.00 |
| Dispersant 1 - carboxylate-capped PIBSA | 5.20 | 0.00 | 5.20 |
| Dispersant 2 - uncapped PIBSA | 0.00 | 4.33 | 0.00 |
| Detergent 1 - metal salicylate or mixtures | 2.20 | 3.00 | 2.00 |
| Detergent 2 - metal sulfonate or mixtures | 0.00 | 0.00 | 0.00 |
| Viscosity Modifier 1 - diblock olefin copolymer | 2.00 | 3.60 | 4.60 |
| Viscosity Modifier 2 - star olefin copolymer | 4.20 | 0.00 | 4.90 |
| Viscosity Modifier 3 - star olefin copolymer | 0.00 | 3.00 | 0.00 |
| Viscosity Modifier 4 - polymethacrylate | 0.00 | 0.00 | 0.90 |
| Additive Package | 5.99 | 6.62 | 5.84 |
| TOTAL | 100 | 100 | 100.00 |

Fig. 3

| Comparative Examples | Comp. Ex. A | Comp. Ex. B | Comp. Ex. C |
|---|---|---|---|
| | | | |
| **Bench Data:** | | | |
| KV100 | 11.9 | 11.9 | 12.2 |
| KV40 | 64.8 | 64.4 | 67.3 |
| KV100 (Base Oil Only) | 4.3 | 4.2 | 4.2 |
| HTHS at 150 °C | 3.5 | 3.5 | 3.5 |
| CCS at -35 °C | 5930 | 5570 | 5990 |
| | | | |
| **Engine Data:** | | | |
| Diesel Polycyclic Endurance Test | | | |
| Average Inlet Roller Follower Clearance (mm) | 0.12 | 0.05 | 0.07 |
| Average Outlet Roller Follower Clearance (mm) | 0.20 | 0.29 | 0.08 |
| Average Total Roller Follower Clearance (mm) | 0.16 | 0.17 | 0.08 |
| Rear-Side Counterbalancer wear (mm) | 0.00 | 0.04 | - |
| Front-Side Counter balancer wear (mm) | 0.03 | 0.04 | - |
| GM Roller Follower Wear Test | | | |
| Average Pin Wear (mils) | 0.77 | - | - |
| Cleanliness, merits | 9.5 | - | - |
| Gasoline valve train wear, microns | 15 | - | - |
| Fuel Economy, % Improvement | 2.6 | - | - |

Fig. 3 (Cont.)

| Comparative Examples | Comp. Ex. D | Comp. Ex. E | Comp. Ex. F |
|---|---|---|---|
| | | | |
| **Bench Data:** | | | |
| KV100 | 12.1 | 12.4 | 11.9 |
| KV40 | 66.1 | 67.9 | 65.8 |
| KV100 (Base Oil Only) | 4.2 | 4.2 | 4.5 |
| HTHS at 150 °C | 3.5 | 3.5 | 3.5 |
| CCS at -35 °C | 5690 | 6000 | 6010 |
| | | | |
| **Engine Data:** | | | |
| Diesel Polycyclic Endurance Test | | | |
| Average Inlet Roller Follower Clearance (mm) | 0.05 | 0.07 | 0.13 |
| Average Outlet Roller Follower Clearance (mm) | 0.07 | 0.13 | 0.19 |
| Average Total Roller Follower Clearance (mm) | 0.11 | 0.10 | 0.16 |
| Rear-Side Counterbalancer wear (mm) | - | - | - |
| Front-Side Counter balancer wear (mm) | - | - | - |
| GM Roller Follower Wear Test | | | |
| Average Pin Wear (mils) | - | - | - |
| Cleanliness, merits | - | - | - |
| Gasoline valve train wear, microns | - | - | - |
| Fuel Economy, % Improvement | - | - | - |

Fig. 3 (Cont.)

| Comparative Examples | Comp. Ex. G | Comp. Ex. H | Comp. Ex. I |
|---|---|---|---|
| | | | |
| **Bench Data:** | | | |
| KV100 | 12.3 | 11.9 | 11.8 |
| KV40 | 67.1 | 65.4 | 64.5 |
| KV100 (Base Oil Only) | 4.2 | 4.4 | 4.3 |
| HTHS at 150 °C | 3.5 | 3.5 | 3.5 |
| CCS at -35 °C | 5860 | 6130 | 5630 |
| | | | |
| **Engine Data:** | | | |
| Diesel Polycyclic Endurance Test | | | |
| Average Inlet Roller Follower Clearance (mm) | 0.07 | 0.06 | 0.06 |
| Average Outlet Roller Follower Clearance (mm) | 0.12 | 0.10 | 0.19 |
| Average Total Roller Follower Clearance (mm) | 0.09 | 0.08 | 0.12 |
| Rear-Side Counterbalancer wear (mm) | - | - | - |
| Front-Side Counter balancer wear (mm) | - | - | - |
| GM Roller Follower Wear Test | | | |
| Average Pin Wear (mils) | - | - | - |
| Cleanliness, merits | - | - | - |
| Gasoline valve train wear, microns | - | - | - |
| Fuel Economy, % Improvement | - | - | - |

Fig. 4

| Examples | Ex. 1 | Ex. 2 | Ex. 3 |
|---|---|---|---|
| **Bench Data:** | | | |
| KV100 | 12.2 | 12.1 | 12.2 |
| KV40 | 62.7 | 66.1 | 66.4 |
| KV100 (Base Oil Only) | 4.6 | 4.6 | 4.3 |
| HTHS at 150 °C | 3.5 | 3.5 | 3.5 |
| CCS at -35 °C | 5920 | 5660 | 6370 |
| CCS at -30 °C | - | - | - |
| | | | |
| **Engine Data:** | | | |
| Diesel Polycyclic Endurance Test | | | |
| Average Inlet Roller Follower Clearance (mm) | 0.04 | - | 0.06 |
| Average Outlet Roller Follower Clearance (mm) | 0.04 | 0.06 | 0.06 |
| Average Total Roller Follower Clearance (mm) | 0.04 | 0.06 | 0.06 |
| Rear-Side Counterbalancer wear (mm) | 0.04 | 0.03 | 0.02 |
| Front-Side Counterbalancer wear (mm) | 0.11 | 0.04 | 0.05 |
| GM Roller Follower Wear Test | | | |
| Average Pin Wear (mils) | - | - | - |
| Cleanliness, merits | 9.5 | - | - |
| Gasoline valve train wear, microns | - | - | - |
| Fuel Economy, % Improvement | 2.6 | - | - |

Fig. 4 (Cont.)

| Examples | Ex. 4 | Ex. 5 | Ex. 6 |
|---|---|---|---|
| **Bench Data:** | | | |
| KV100 | 12.2 | 12.0 | 12.3 |
| KV40 | 63.8 | 63.2 | 63.3 |
| KV100 (Base Oil Only) | 4.5 | 4.5 | 4.6 |
| HTHS at 150 °C | 3.5 | 3.5 | 3.5 |
| CCS at -35 °C | 5860 | 5910 | 6080 |
| CCS at -30 °C | - | - | - |
| | | | |
| **Engine Data:** | | | |
| Diesel Polycyclic Endurance Test | | | |
| Average Inlet Roller Follower Clearance (mm) | 0.03 | 0.04 | 0.03 |
| Average Outlet Roller Follower Clearance (mm) | 0.02 | 0.04 | 0.03 |
| Average Total Roller Follower Clearance (mm) | 0.02 | 0.04 | 0.03 |
| Rear-Side Counterbalancer wear (mm) | 0.03 | 0.04 | - |
| Front-Side Counterbalancer wear (mm) | 0.09 | 0.05 | - |
| GM Roller Follower Wear Test | | | |
| Average Pin Wear (mils) | - | - | - |
| Cleanliness, merits | 9.6 | 9.6 | - |
| Gasoline valve train wear, microns | - | - | - |
| Fuel Economy, % Improvement | 2.6 | 2.5 | - |

Fig. 4 (Cont.)

| Examples | Ex. 7 | Ex. 8 | Ex. 9 |
|---|---|---|---|
| **Bench Data:** | | | |
| KV100 | 12.0 | 7.8 | 12.2 |
| KV40 | 71.5 | 39.0 | 65.0 |
| KV100 (Base Oil Only) | 6.0 | 4.0 | 4.3 |
| HTHS at 150 °C | 3.6 | 2.6 | 3.5 |
| CCS at -35 °C | - | 4200 | 5770 |
| CCS at -30 °C | 5460 | - | - |
| | | | |
| **Engine Data:** | | | |
| Diesel Polycyclic Endurance Test | | | |
| Average Inlet Roller Follower Clearance (mm) | 0.03 | 0.03 | 0.06 |
| Average Outlet Roller Follower Clearance (mm) | 0.03 | 0.03 | 0.05 |
| Average Total Roller Follower Clearance (mm) | 0.03 | 0.03 | 0.06 |
| Rear-Side Counterbalancer wear (mm) | 0.00 | 0.01 | 0.02 |
| Front-Side Counterbalancer wear (mm) | 0.03 | 0.02 | 0.10 |
| GM Roller Follower Wear Test | | | |
| Average Pin Wear (mils) | 0.41 | - | - |
| Cleanliness, merits | 9.4 | 9.5 | - |
| Gasoline valve train wear, microns | 15 | 2 | - |
| Fuel Economy, % Improvement | 2.0 | 4.1 | - |

Fig. 5

| | Comp. Ex. A | Comp. Ex. J | Comp. Ex. K |
|---|---|---|---|
| Group III | 46.00 | 46.00 | 0.00 |
| Group IV | 24.46 | 25.00 | 70.96 |
| Group V - Ester | 5.00 | 5.00 | 5.00 |
| Group V - Alkylated Naphthalene | 0.00 | 0.00 | 0.00 |
| Dispersant 1 - carboxylate-capped PIBSA | 5.20 | 5.20 | 5.20 |
| Dispersant 2 - uncapped PIBSA | 0.00 | 0.00 | 0.00 |
| Detergent 1 - metal salicylate or mixtures | 3.00 | 2.35 | 3.00 |
| Detergent 2 - metal sulfonate or mixtures | 0.00 | 0.00 | 0.00 |
| Viscosity Modifier 1 - diblock olefin copolymer | 5.00 | 5.00 | 4.00 |
| Viscosity Modifier 2 - star olefin copolymer | 5.50 | 5.50 | 6.00 |
| Viscosity Modifier 3 - star olefin copolymer | 0.00 | 0.00 | 0.00 |
| Viscosity Modifier 4 - polymethacrylate | 0.00 | 0.00 | 0.00 |
| Additive Package | 5.84 | 5.95 | 5.84 |
| TOTAL | 100.00 | 100 | 100 |

Fig. 5 (Cont.)

| | Comp. Ex. L | Ex. 7 | Ex. 10 |
|---|---|---|---|
| Group III | 46.11 | 30.41 | 46.00 |
| Group IV | 25.00 | 45.00 | 26.00 |
| Group V - Ester | 5.00 | 5.00 | 5.00 |
| Group V - Alkylated Naphthalene | 0.00 | 0.00 | 0.00 |
| Dispersant 1 - carboxylate-capped PIBSA | 5.20 | 5.20 | 0.00 |
| Dispersant 2 - uncapped PIBSA | 0.00 | 0.00 | 4.33 |
| Detergent 1 - metal salicylate or mixtures | 2.20 | 2.20 | 2.35 |
| Detergent 2 - metal sulfonate or mixtures | 0.00 | 0.00 | 0.00 |
| Viscosity Modifier 1 - diblock olefin copolymer | 5.00 | 2.00 | 5.00 |
| Viscosity Modifier 2 - star olefin copolymer | 5.50 | 4.20 | 5.50 |
| Viscosity Modifier 3 - star olefin copolymer | 0.00 | 0.00 | 0.00 |
| Viscosity Modifier 4 - polymethacrylate | 0.00 | 0.00 | 0.00 |
| Additive Package | 5.99 | 5.99 | 5.82 |
| TOTAL | 100 | 100 | 100 |

Fig. 5 (Cont.)

| | Ex. 11 | Ex. 8 |
|---|---|---|
| Group III | 50.41 | 54.05 |
| Group IV | 20.00 | 20.00 |
| Group V - Ester | 5.00 | 5.40 |
| Group V - Alkylated Naphthalene | 0.00 | 0.00 |
| Dispersant 1 - carboxylate-capped PIBSA | 5.20 | 0.00 |
| Dispersant 2 - uncapped PIBSA | 0.00 | 4.33 |
| Detergent 1 - metal salicylate or mixtures | 3.00 | 3.00 |
| Detergent 2 - metal sulfonate or mixtures | 0.00 | 0.00 |
| Viscosity Modifier 1 - diblock olefin copolymer | 4.40 | 3.60 |
| Viscosity Modifier 2 - star olefin copolymer | 4.80 | 0.00 |
| Viscosity Modifier 3 - star olefin copolymer | 0.00 | 3.00 |
| Viscosity Modifier 4 - polymethacrylate | 1.20 | 0.00 |
| Additive Package | 5.99 | 6.62 |
| TOTAL | 100 | 100 |

Fig. 6

| | Comp. Ex. A | Comp. Ex. J | Comp. Ex. K |
|---|---|---|---|
| | | | |
| **Bench Data:** | | | |
| KV100 | 11.9 | 12.2 | 12.0 |
| KV40 | 64.8 | 66.3 | 66.8 |
| KV100 (Base Oil Only) | 4.3 | 4.3 | 4.4 |
| HTHS at 150 °C | 3.5 | 3.5 | 3.5 |
| CCS at -35 °C | 5930 | 5730 | 5320 |
| | | | |
| **Engine Data:** | | | |
| Diesel Polycyclic Endurance Test | | | |
| Average Inlet Roller Follower Clearance (mm) | 0.12 | 0.14 | 0.11 |
| Average Outlet Roller Follower Clearance (mm) | 0.20 | 0.27 | 0.17 |
| Average Total Roller Follower Clearance (mm) | 0.16 | 0.21 | 0.14 |
| GM Roller Follower Wear Test | | | |
| Average Pin Wear (mils) | 0.77 | 0.52 | - |
| | | | |

Fig. 6 (Cont.)

| | Comp. Ex. L | Ex. 7 | Ex. 10 |
|---|---|---|---|
| | | | |
| **Bench Data:** | | | |
| KV100 | 12.0 | 12.0 | 12.1 |
| KV40 | 66.3 | 71.5 | 66.3 |
| KV100 (Base Oil Only) | 4.4 | 6.0 | 4.3 |
| HTHS at 150 °C | 3.5 | 3.6 | 3.5 |
| CCS at -35 °C | - | - | 5820 |
| | | | |
| **Engine Data:** | | | |
| Diesel Polycyclic Endurance Test | | | |
| Average Inlet Roller Follower Clearance (mm) | 0.05 | 0.03 | 0.04 |
| Average Outlet Roller Follower Clearance (mm) | 0.19 | 0.03 | 0.05 |
| Average Total Roller Follower Clearance (mm) | 0.12 | 0.03 | 0.05 |
| GM Roller Follower Wear Test | | | |
| Average Pin Wear (mils) | - | 0.41 | 0.35 |
| | | | |

Fig. 6 (Cont.)

| | Ex. 11 | Ex. 8 |
|---|---|---|
| | | |
| **Bench Data:** | | |
| KV100 | 12.2 | 7.8 |
| KV40 | 64.2 | 39.0 |
| KV100 (Base Oil Only) | 4.3 | 4.0 |
| HTHS at 150 °C | 3.5 | 2.6 |
| CCS at -35 °C | 5700 | 4200 |
| | | |
| **Engine Data:** | | |
| Diesel Polycyclic Endurance Test | | |
| Average Inlet Roller Follower Clearance (mm) | 0.06 | 0.02 |
| Average Outlet Roller Follower Clearance (mm) | 0.10 | 0.03 |
| Average Total Roller Follower Clearance (mm) | 0.08 | 0.03 |
| GM Roller Follower Wear Test | | |
| Average Pin Wear (mils) | 0.47 | - |
| | | |

Fig. 7

| Step | Speed [1/min] | Load [Nm] | Time [s] |
|---|---|---|---|
| 1 | 1000 | 100 | 120 |
| 2 | 2000 | 176 | 120 |
| 3 | 1200 | 128 | 120 |
| 4 | 2200 | 176 | 120 |
| 5 | 1400 | 172 | 120 |
| 6 | 2400 | 176 | 120 |
| 7 | 1600 | 176 | 120 |
| 8 | 2600 | 176 | 120 |
| 9 | 1800 | 176 | 120 |
| 10 | 1800 | 176 | 120 |
| 11 | 2000 | 176 | 120 |
| 12 | 3000 | 176 | 120 |
| 13 | 2200 | 176 | 120 |
| 14 | 3200 | 174 | 120 |
| 15 | 2400 | 176 | 120 |
| 16 | 3400 | 172 | 120 |
| 17 | 2600 | 176 | 120 |
| 18 | 3600 | 170 | 120 |
| 19 | 2800 | 176 | 120 |
| 20 | 3800 | 168 | 120 |

Fig. 7 (Cont.)

| Step | Speed [1/min] | Load [Nm] | Time [s] |
|---|---|---|---|
| 21 | 3000 | 176 | 120 |
| 22 | 4000 | 156 | 120 |
| 23 | 3200 | 174 | 120 |
| 24 | 4200 | 136 | 120 |
| 25 | 3000 | 176 | 120 |
| 26 | 4000 | 156 | 120 |
| 27 | 2800 | 176 | 120 |
| 28 | 3800 | 168 | 120 |
| 29 | 2600 | 176 | 120 |
| 30 | 3600 | 170 | 120 |
| 31 | 2400 | 176 | 120 |
| 32 | 3400 | 172 | 120 |
| 33 | 2200 | 176 | 120 |
| 34 | 3200 | 174 | 120 |
| 35 | 2000 | 176 | 120 |
| 36 | 3000 | 176 | 120 |
| 37 | 1800 | 176 | 120 |
| 38 | 2800 | 176 | 120 |
| 39 | 1600 | 176 | 120 |
| 40 | 2600 | 176 | 120 |

Fig. 7 (Cont.)

| Step | Speed [1/min] | Load [Nm] | Time [s] |
|---|---|---|---|
| 41 | 1400 | 172 | 120 |
| 42 | 2400 | 176 | 120 |
| 43 | 1200 | 128 | 120 |
| 44 | 2200 | 176 | 120 |
| 45 | 1000 | 100 | 60 |
| 46 | 0 | 0 | 60 |
| Engine Start | | | |
| 47 | 1000 | 138 | 120 |
| 48 | 2000 | 242 | 120 |
| 49 | 1200 | 176 | 120 |
| 50 | 2200 | 242 | 120 |
| 51 | 1400 | 237 | 120 |
| 52 | 2400 | 242 | 120 |
| 53 | 1600 | 242 | 120 |
| 54 | 2600 | 242 | 120 |
| 55 | 1800 | 242 | 120 |
| 56 | 1800 | 242 | 120 |
| 57 | 2000 | 242 | 120 |
| 58 | 3000 | 242 | 120 |
| 59 | 2200 | 242 | 120 |
| 60 | 3200 | 239 | 120 |

Fig. 7 (Cont.)

| Step | Speed [1/min] | Load [Nm] | Time [s] |
|---|---|---|---|
| 61 | 2400 | 242 | 120 |
| 62 | 3400 | 237 | 120 |
| 63 | 2600 | 242 | 120 |
| 64 | 3600 | 234 | 120 |
| 65 | 2800 | 242 | 120 |
| 66 | 3800 | 231 | 120 |
| 67 | 3000 | 242 | 120 |
| 68 | 4000 | 215 | 120 |
| 69 | 3200 | 239 | 120 |
| 70 | 4200 | 187 | 120 |
| 71 | 3000 | 242 | 120 |
| 72 | 4000 | 215 | 120 |
| 73 | 2800 | 242 | 120 |
| 74 | 3800 | 231 | 120 |
| 75 | 2600 | 242 | 120 |
| 76 | 3600 | 234 | 120 |
| 77 | 2400 | 242 | 120 |
| 78 | 3400 | 237 | 120 |
| 79 | 2200 | 242 | 120 |
| 80 | 3200 | 239 | 120 |

Fig. 7 (Cont.)

| Step | Speed [1/min] | Load [Nm] | Time [s] |
|---|---|---|---|
| 81 | 2000 | 242 | 120 |
| 82 | 3000 | 242 | 120 |
| 83 | 1800 | 242 | 120 |
| 84 | 2800 | 242 | 120 |
| 85 | 1600 | 242 | 120 |
| 86 | 2600 | 242 | 120 |
| 87 | 1400 | 237 | 120 |
| 88 | 2400 | 242 | 120 |
| 89 | 1200 | 176 | 120 |
| 90 | 2200 | 242 | 120 |
| 91 | 1000 | 138 | 60 |
| 92 | 0 | 0 | 60 |
| **Engine Start** | | | |
| 93 | 1000 | 175 | 120 |
| 94 | 2000 | 308 | 120 |
| 95 | 1200 | 224 | 120 |
| 96 | 2200 | 308 | 120 |
| 97 | 1400 | 301 | 120 |
| 98 | 2400 | 308 | 120 |
| 99 | 1600 | 308 | 120 |
| 100 | 2600 | 308 | 120 |

Fig. 7 (Cont.)

| Step | Speed [1/min] | Load [Nm] | Time [s] |
|---|---|---|---|
| 101 | 1800 | 308 | 120 |
| 102 | 2800 | 308 | 120 |
| 103 | 2000 | 308 | 120 |
| 104 | 3000 | 308 | 120 |
| 105 | 2200 | 308 | 120 |
| 106 | 3200 | 305 | 120 |
| 107 | 2400 | 308 | 120 |
| 108 | 3400 | 301 | 120 |
| 109 | 2600 | 308 | 120 |
| 110 | 3600 | 298 | 120 |
| 111 | 2800 | 308 | 120 |
| 112 | 3800 | 294 | 120 |
| 113 | 3000 | 308 | 120 |
| 114 | 4000 | 273 | 120 |
| 115 | 3200 | 305 | 120 |
| 116 | 4200 | 238 | 120 |
| 117 | 3000 | 308 | 120 |
| 118 | 4000 | 273 | 120 |
| 119 | 2800 | 308 | 120 |
| 120 | 3800 | 294 | 120 |

Fig. 7 (Cont.)

| Step | Speed [1/min] | Load [Nm] | Time [s] |
|---|---|---|---|
| 121 | 2600 | 308 | 120 |
| 122 | 3600 | 298 | 120 |
| 123 | 2400 | 308 | 120 |
| 124 | 3400 | 301 | 120 |
| 125 | 2200 | 308 | 120 |
| 126 | 3200 | 305 | 120 |
| 127 | 2000 | 308 | 120 |
| 128 | 3000 | 308 | 120 |
| 129 | 2800 | 308 | 120 |
| 130 | 3800 | 294 | 120 |
| 131 | 2600 | 308 | 120 |
| 132 | 3600 | 298 | 120 |
| 133 | 2400 | 308 | 120 |
| 134 | 3400 | 301 | 120 |
| 135 | 2200 | 308 | 120 |
| 136 | 3200 | 305 | 120 |
| 137 | 2000 | 308 | 60 |
| 138 | 0 | 0 | 60 |
| Engine Start | | | |

Fig. 8

| Step | Speed [1/min] | Load | Time [s] |
|---|---|---|---|
| VL_1000 | 1000 | 100% | 180 |
| VL_1250 | 1250 | 100% | 180 |
| VL_1500 | 1500 | 100% | 180 |
| VL_1750 | 1750 | 100% | 180 |
| VL_2000 | 2000 | 100% | 180 |
| VL_2500 | 2500 | 100% | 180 |
| VL_3000 | 3000 | 100% | 180 |
| VL_3500 | 3500 | 100% | 180 |
| VL_3750 | 3750 | 100% | 180 |
| VL_4000 | 4000 | 100% | 180 |
| VL_4400 | 4400 | 100% | 180 |
| VL_4500 | 4500 | 100% | 180 |

Fig. 9

| Step | Speed [1/min] | Load [Nm] | Time [s] |
|---|---|---|---|
| QD_1350_VL | 1350 | 100% | 300 |
| QD_1350_350 | 1350 | 350 | 30 |
| QD_1350_300 | 1350 | 300 | 30 |
| QD_1350_250 | 1350 | 250 | 30 |
| QD_1350_200 | 1350 | 200 | 30 |
| QD_1350_150 | 1350 | 150 | 30 |
| QD_1350_100 | 1350 | 100 | 30 |
| QD_1350_80 | 1350 | 80 | 30 |
| QD_1350_60 | 1350 | 60 | 30 |
| QD_1350_40 | 1350 | 40 | 30 |
| QD_1350_20 | 1350 | 20 | 30 |
| **Step** | **Speed [1/min]** | **Load [Nm]** | **Time [s]** |
| QD_1500_VL | 1500 | 100% | 300 |
| QD_1500_400 | 1500 | 400 | 30 |
| QD_1500_350 | 1500 | 350 | 30 |
| QD_1500_300 | 1500 | 300 | 30 |
| QD_1500_250 | 1500 | 250 | 30 |
| QD_1500_200 | 1500 | 200 | 30 |
| QD_1500_150 | 1500 | 150 | 30 |
| QD_1500_100 | 1500 | 100 | 30 |
| QD_1500_80 | 1500 | 80 | 30 |
| QD_1500_60 | 1500 | 60 | 30 |
| QD_1500_40 | 1500 | 40 | 30 |
| QD_1500_20 | 1500 | 20 | 30 |

Fig. 9 (Cont.)

| Step | Speed [1/min] | Load [Nm] | Time [s] |
|---|---|---|---|
| QD_2000_VL | 2000 | 100% | 300 |
| QD_2000_400 | 2000 | 400 | 30 |
| QD_2000_350 | 2000 | 350 | 30 |
| QD_2000_300 | 2000 | 300 | 30 |
| QD_2000_250 | 2000 | 250 | 30 |
| QD_2000_200 | 2000 | 200 | 30 |
| QD_2000_150 | 2000 | 150 | 30 |
| QD_2000_100 | 2000 | 100 | 30 |
| QD_2000_80 | 2000 | 80 | 30 |
| QD_2000_60 | 2000 | 60 | 30 |
| QD_2000_40 | 2000 | 40 | 30 |
| QD_2000_20 | 2000 | 20 | 30 |
| **Step** | **Speed [1/min]** | **Load [Nm]** | **Time [s]** |
| QD_2500_VL | 2500 | 100% | 300 |
| QD_2500_400 | 2500 | 400 | 30 |
| QD_2500_350 | 2500 | 350 | 30 |
| QD_2500_300 | 2500 | 300 | 30 |
| QD_2500_250 | 2500 | 250 | 30 |
| QD_2500_200 | 2500 | 200 | 30 |
| QD_2500_150 | 2500 | 150 | 30 |
| QD_2500_100 | 2500 | 100 | 30 |
| QD_2500_80 | 2500 | 80 | 30 |
| QD_2500_60 | 2500 | 60 | 30 |
| QD_2500_40 | 2500 | 40 | 30 |
| QD_2500_20 | 2500 | 20 | 30 |

Fig. 9 (Cont.)

| Step | Speed [1/min] | Load [Nm] | Time [s] |
|---|---|---|---|
| QD_3000_VL | 3000 | 100% | 300 |
| QD_3000_400 | 3000 | 400 | 30 |
| QD_3000_350 | 3000 | 350 | 30 |
| QD_3000_300 | 3000 | 300 | 30 |
| QD_3000_250 | 3000 | 250 | 30 |
| QD_3000_200 | 3000 | 200 | 30 |
| QD_3000_150 | 3000 | 150 | 30 |
| QD_3000_100 | 3000 | 100 | 30 |
| QD_3000_80 | 3000 | 80 | 30 |
| QD_3000_60 | 3000 | 60 | 30 |
| QD_3000_40 | 3000 | 40 | 30 |
| QD_3000_20 | 3000 | 20 | 30 |
| **Step** | **Speed [1/min]** | **Load [Nm]** | **Time [s]** |
| QD_3500_VL | 3500 | 100% | 300 |
| QD_3500_350 | 3500 | 350 | 30 |
| QD_3500_300 | 3500 | 300 | 30 |
| QD_3500_250 | 3500 | 250 | 30 |
| QD_3500_200 | 3500 | 200 | 30 |
| QD_3500_150 | 3500 | 150 | 30 |
| QD_3500_100 | 3500 | 100 | 30 |
| QD_3500_80 | 3500 | 80 | 30 |
| QD_3500_60 | 3500 | 60 | 30 |
| QD_3500_40 | 3500 | 40 | 30 |
| QD_3500_20 | 3500 | 20 | 30 |

Fig. 9 (Cont.)

| Step | Speed [1/min] | Load [Nm] | Time [s] |
|---|---|---|---|
| QD_4000_VL | 4000 | 100% | 300 |
| QD_4000_300 | 4000 | 300 | 30 |
| QD_4000_250 | 4000 | 250 | 30 |
| QD_4000_200 | 4000 | 200 | 30 |
| QD_4000_150 | 4000 | 150 | 30 |
| QD_4000_100 | 4000 | 100 | 30 |
| QD_4000_80 | 4000 | 80 | 30 |
| QD_4000_60 | 4000 | 60 | 30 |
| QD_4000_40 | 4000 | 40 | 30 |
| QD_4000_20 | 4000 | 20 | 30 |
| **Step** | **Speed [1/min]** | **Load [Nm]** | **Time [s]** |
| QD_4400_VL | 4400 | 100% | 300 |
| QD_4400_250 | 4400 | 250 | 30 |
| QD_4400_200 | 4400 | 200 | 30 |
| QD_4400_150 | 4400 | 150 | 30 |
| QD_4400_100 | 4400 | 100 | 30 |
| QD_4400_80 | 4400 | 80 | 30 |
| QD_4400_60 | 4400 | 60 | 30 |
| QD_4400_40 | 4400 | 40 | 30 |
| QD_4400_20 | 4400 | 20 | 30 |

Fig. 10

| Step | Speed | Load | Time per step | Overall running time |
|---|---|---|---|---|
| | [1/min] | [Nm] or %Throttle | [s] | [min] |
| 1 | 0 | 0% | 300 | 5.0 |
| 2 | 4500 | 100% | 180 | 8.0 |
| 3 | 4500 | 100% | 300 | 13.0 |
| 4 | 1000 | 100% | 120 | 15.0 |
| 5 | 5200 | 100% | 30 | 15.5 |
| 6 | 1500 | 100% | 330 | 21.0 |
| 7 | 5000 | 100% | 19 | 21.3 |
| 8 | 1000 | 200 | 15 | 21.6 |
| 9 | 1000 | 100% | 180 | 24.6 |
| 10 | 4900 | 100% | 19 | 24.9 |
| 11 | 1100 | 200 | 15 | 25.1 |
| 12 | 1100 | 100% | 180 | 28.1 |
| 13 | 4800 | 100% | 19 | 28.5 |
| 14 | 1200 | 200 | 15 | 28.7 |
| 15 | 1200 | 100% | 180 | 31.7 |
| 16 | 4700 | 100% | 19 | 32.0 |
| 17 | 1300 | 200 | 15 | 32.3 |
| 18 | 1300 | 100% | 180 | 35.3 |
| 19 | 4600 | 100% | 19 | 35.6 |
| 20 | 1400 | 200 | 15 | 35.8 |

Fig. 10 (Cont.)

| Step | Speed | Load | Time per step | Overall running time |
|---|---|---|---|---|
| | [1/min] | [Nm] or %Throttle | [s] | [min] |
| 21 | 1400 | 100% | 180 | 38.8 |
| 22 | 4500 | 100% | 19 | 39.2 |
| 23 | 1500 | 200 | 15 | 39.4 |
| 24 | 1500 | 100% | 180 | 42.4 |
| 25 | 4400 | 100% | 19 | 42.7 |
| 26 | 1600 | 200 | 15 | 43.0 |
| 27 | 1600 | 100% | 180 | 46.0 |
| 28 | 4300 | 100% | 19 | 46.3 |
| 29 | 1700 | 200 | 15 | 46.5 |
| 30 | 1700 | 100% | 180 | 49.5 |
| 31 | 4200 | 100% | 19 | 49.9 |
| 32 | 1800 | 200 | 15 | 50.1 |
| 33 | 1800 | 100% | 180 | 53.1 |
| 34 | 4100 | 100% | 19 | 53.4 |
| 35 | 1900 | 200 | 15 | 53.7 |
| 36 | 1900 | 100% | 180 | 56.7 |
| 37 | 4000 | 100% | 19 | 57.0 |
| 38 | 2000 | 200 | 15 | 57.2 |
| 39 | 2000 | 100% | 180 | 60.2 |
| 40 | 3900 | 100% | 19 | 60.6 |

Fig. 10 (Cont.)

| Step | Speed | Load | Time per step | Overall running time |
|---|---|---|---|---|
| | [1/min] | [Nm] or %Throttle | [s] | [min] |
| 41 | 2100 | 200 | 15 | 60.8 |
| 42 | 2100 | 100% | 180 | 63.8 |
| 43 | 3800 | 100% | 180 | 66.8 |
| 44 | 2200 | 200 | 15 | 67.1 |
| 45 | 2200 | 100% | 180 | 70.1 |
| 46 | 3700 | 100% | 180 | 73.1 |
| 47 | 2300 | 200 | 15 | 73.3 |
| 48 | 2300 | 100% | 180 | 76.3 |
| 49 | 3600 | 100% | 180 | 79.3 |
| 50 | 2400 | 100% | 180 | 82.3 |
| 51 | 3500 | 100% | 180 | 85.3 |
| 52 | 2500 | 100% | 180 | 88.3 |
| 53 | 3400 | 100% | 180 | 91.3 |
| 54 | 2600 | 100% | 180 | 94.3 |
| 55 | 3300 | 100% | 180 | 97.3 |
| 56 | 2700 | 100% | 180 | 100.3 |
| 57 | 3200 | 100% | 180 | 103.3 |
| 58 | 2800 | 100% | 180 | 106.3 |
| 59 | 3100 | 100% | 180 | 109.3 |
| 60 | 2900 | 100% | 180 | 112.3 |

Fig. 10 (Cont.)

| Step | Speed | Load | Time per step | Overall running time |
|---|---|---|---|---|
| | [1/min] | [Nm] or %Throttle | [s] | [min] |
| 61 | 3000 | 100% | 180 | 115.3 |
| 62 | 1500 | 100% | 300 | 120.3 |
| 63 | 4500 | 100% | 300 | 125.3 |
| 64 | 0 | 0% | 120 | 127.3 |
| 65 | 0 | 0% | 300 | 132.3 |
| 66 | 4500 | 100% | 180 | 135.3 |
| 67 | 1000 | 100% | 120 | 137.3 |
| 68 | 5200 | 100% | 30 | 137.8 |
| 69 | 1500 | 100% | 330 | 143.3 |
| 70 | 4500 | 100% | 420 | 150.3 |
| 71 | 4500 | 0% | 180 | 153.3 |
| 72 | 4500 | 100% | 420 | 160.3 |
| 73 | 4500 | 0% | 180 | 163.3 |
| 74 | 1500 | 100% | 300 | 168.3 |
| 75 | 4500 | 100% | 300 | 173.3 |
| 76 | 0 | 0% | 120 | 175.3 |

Fig. 11

| Examples | 12 | 13 |
|---|---|---|
| **Formulation Components** | | |
| Tungsten & Sulfur-containing compounds | 0.2 | 0.2 |
| Mg and/or Ca sulfonates | 2 | 2 |
| Mg and/or Ca salicylates | 2 | 2 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0.5 | 0.5 |
| Olefin-based polymers (block, star, and/or mixed) | 2 | 2 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.3 | 0.3 |
| Silicone compounds | 0.1 | 0.1 |
| Alkoxylated alcohols | 1 | 1 |
| Group II, III, IV, V base stock and/or mixtures | 85 | 85 |
| Group II base stock | - | 30 |
| Group III base stock | 30 | 0 |
| Group IV base stock | 50 | 50 |
| Group V base stock | 5 | 5 |
| | 100 | 100 |

Fig. 11 (Cont.)

| **Examples** | **14** | **15** |
|---|---|---|
| **Formulation Components** | | |
| Tungsten & Sulfur-containing compounds | 0.2 | 0.2 |
| Mg and/or Ca sulfonates | 1 | 2 |
| Mg and/or Ca salicylates | 2 | 1 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0 | 0 |
| Olefin-based polymers (block, star, and/or mixed) | 2 | 2 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.8 | 0.8 |
| Silicone compounds | 0.1 | 0.1 |
| Alkoxylated alcohols | 2 | 2 |
| Group II, III, IV, V base stock and/or mixtures | 85 | 85 |
| Group II base stock | 0 | 30 |
| Group III base stock | 30 | 0 |
| Group IV base stock | 50 | 50 |
| Group V base stock | 5 | 5 |
| | 100 | 100 |

Fig. 11 (Cont.)

| **Examples** | **16** | **17** |
|---|---|---|
| **Formulation Components** | | |
| Tungsten & Sulfur-containing compounds | 0.2 | 0.5 |
| Mg and/or Ca sulfonates | 2 | 2 |
| Mg and/or Ca salicylates | 2 | 2 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0.5 | 0.5 |
| Olefin-based polymers (block, star, and/or mixed) | 2 | 2 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.3 | 0.3 |
| Silicone compounds | 0.1 | 0.1 |
| Alkoxylated alcohols | 0 | 1 |
| Group II, III, IV, V base stock and/or mixtures | 86 | 84.7 |
| Group II base stock | 0 | 30 |
| Group III base stock | 31 | 0 |
| Group IV base stock | 50 | 49.7 |
| Group V base stock | 5 | 5 |
| | 100 | 100 |

Fig. 11 (Cont.)

| **Examples** | **18** | **19** |
|---|---|---|
| **Formulation Components** | | |
| Tungsten & Sulfur-containing compounds | 0.5 | 0.5 |
| Mg and/or Ca sulfonates | 1 | 2 |
| Mg and/or Ca salicylates | 2 | 1 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0 | 0 |
| Olefin-based polymers (block, star, and/or mixed) | 2 | 2 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.8 | 0.8 |
| Silicone compounds | 0.1 | 0.1 |
| Alkoxylated alcohols | 0 | 2 |
| Group II, III, IV, V base stock and/or mixtures | 86.7 | 84.7 |
| Group II base stock | 0 | 30 |
| Group III base stock | 31.7 | 0 |
| Group IV base stock | 50 | 49.7 |
| Group V base stock | 5 | 5 |
| | 100 | 100 |

Fig. 11 (Cont.)

| **Examples** | **20** | **21** |
|---|---|---|
| **Formulation Components** | | |
| Tungsten & Sulfur-containing compounds | 0.2 | 0.2 |
| Mg and/or Ca sulfonates | 0 | 0 |
| Mg and/or Ca salicylates | 2 | 0.3 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0.5 | 0.5 |
| Olefin-based polymers (block, star, and/or mixed) | 2 | 2 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.3 | 0.3 |
| Silicone compounds | 0.1 | 0.1 |
| Alkoxylated alcohols | 1 | 1 |
| Group II, III, IV, V base stock and/or mixtures | 87 | 88.7 |
| Group II base stock | 0 | 33.7 |
| Group III base stock | 32 | 0 |
| Group IV base stock | 50 | 50 |
| Group V base stock | 5 | 5 |
| | 100 | 100 |

Fig. 12

| **Examples** | **22** | **23** |
|---|---|---|
| **Formulation Components** | | |
| Tungsten & Sulfur-containing compounds | 0.2 | 0.2 |
| Mg and/or Ca sulfonates | 2 | 2 |
| Mg and/or Ca salicylates | 2 | 2 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0.5 | 0.5 |
| Olefin-based polymers (block, star, and/or mixed) | 5 | 5 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.3 | 0.3 |
| Silicone compounds | 0.1 | 0.1 |
| Alkoxylated alcohols | 1 | 1 |
| Group II, III, IV, V base stock and/or mixtures | 82 | 82 |
| Group II base stock | 0 | 32 |
| Group III base stock | 32 | 0 |
| Group IV base stock | 45 | 45 |
| Group V base stock | 5 | 5 |
| | 100 | 100 |

Fig. 12 (Cont.)

| **Examples** | **24** | **25** |
|---|---|---|
| **Formulation Components** | | |
| Tungsten & Sulfur-containing compounds | 0.2 | 0.2 |
| Mg and/or Ca sulfonates | 1 | 2 |
| Mg and/or Ca salicylates | 2 | 1 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0 | 0 |
| Olefin-based polymers (block, star, and/or mixed) | 5 | 5 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.8 | 0.8 |
| Silicone compounds | 0.1 | 0.1 |
| Alkoxylated alcohols | 2 | 2 |
| Group II, III, IV, V base stock and/or mixtures | 82 | 82 |
| Group II base stock | 0 | 32 |
| Group III base stock | 32 | 0 |
| Group IV base stock | 45 | 45 |
| Group V base stock | 5 | 5 |
| | 100 | 100 |

Fig. 12 (Cont.)

| **Examples** | **26** | **27** |
|---|---|---|
| **Formulation Components** | | |
| Tungsten & Sulfur-containing compounds | 0.2 | 0.5 |
| Mg and/or Ca sulfonates | 2 | 2 |
| Mg and/or Ca salicylates | 2 | 2 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0.5 | 0.5 |
| Olefin-based polymers (block, star, and/or mixed) | 5 | 5 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.3 | 0.3 |
| Silicone compounds | 0.1 | 0.1 |
| Alkoxylated alcohols | 0 | 1 |
| Group II, III, IV, V base stock and/or mixtures | 83 | 81.7 |
| Group II base stock | 0 | 32 |
| Group III base stock | 33 | 0 |
| Group IV base stock | 45 | 44.7 |
| Group V base stock | 5 | 5 |
| | 100 | 100 |

Fig. 12 (Cont.)

| **Examples** | **28** | **29** |
|---|---|---|
| **Formulation Components** | | |
| Tungsten & Sulfur-containing compounds | 0.5 | 0.5 |
| Mg and/or Ca sulfonates | 1 | 2 |
| Mg and/or Ca salicylates | 2 | 1 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0 | 0 |
| Olefin-based polymers (block, star, and/or mixed) | 5 | 5 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.8 | 0.8 |
| Silicone compounds | 0.1 | 0.1 |
| Alkoxylated alcohols | 0 | 2 |
| Group II, III, IV, V base stock and/or mixtures | 83.7 | 81.7 |
| Group II base stock | 0 | 32 |
| Group III base stock | 33.7 | 0 |
| Group IV base stock | 45 | 44.7 |
| Group V base stock | 5 | 5 |
| | 100 | 100 |

Fig. 12 (Cont.)

| **Examples** | **30** | **31** |
|---|---|---|
| **Formulation Components** | | |
| Tungsten & Sulfur-containing compounds | 0.2 | 0.2 |
| Mg and/or Ca sulfonates | 0 | 0 |
| Mg and/or Ca salicylates | 2 | 0.3 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0.5 | 0.5 |
| Olefin-based polymers (block, star, and/or mixed) | 5 | 5 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.3 | 0.3 |
| Silicone compounds | 0.1 | 0.1 |
| Alkoxylated alcohols | 1 | 1 |
| Group II, III, IV, V base stock and/or mixtures | 84 | 85.7 |
| Group II base stock | 0 | 35.7 |
| Group III base stock | 34 | 0 |
| Group IV base stock | 45 | 45 |
| Group V base stock | 5 | 5 |
| | 100 | 100 |

Fig. 13

| **Examples** | **32** | **33** |
|---|---|---|
| **Formulation Components** | | |
| Tungsten & Sulfur-containing compounds | 0.2 | 0.2 |
| Mg and/or Ca sulfonates | 2 | 2 |
| Mg and/or Ca salicylates | 2 | 2 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0.5 | 0.5 |
| Olefin-based polymers (block, star, and/or mixed) | 10 | 10 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.3 | 0.3 |
| Silicone compounds | 0.1 | 0.1 |
| Alkoxylated alcohols | 1 | 1 |
| Group II, III, IV, V base stock and/or mixtures | 77 | 77 |
| Group II base stock | 0 | 30 |
| Group III base stock | 30 | 0 |
| Group IV base stock | 42 | 42 |
| Group V base stock | 5 | 5 |
| | 100 | 100 |

Fig. 13 (Cont.)

| **Examples** | **34** | **35** |
|---|---|---|
| **Formulation Components** | | |
| Tungsten & Sulfur-containing compounds | 0.2 | 0.2 |
| Mg and/or Ca sulfonates | 1 | 2 |
| Mg and/or Ca salicylates | 2 | 1 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0 | 0 |
| Olefin-based polymers (block, star, and/or mixed) | 10 | 10 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.8 | 0.8 |
| Silicone compounds | 0.1 | 0.1 |
| Alkoxylated alcohols | 2 | 2 |
| Group II, III, IV, V base stock and/or mixtures | 77 | 77 |
| Group II base stock | 0 | 30 |
| Group III base stock | 30 | 0 |
| Group IV base stock | 42 | 42 |
| Group V base stock | 5 | 5 |
| | 100 | 100 |

Fig. 13 (Cont.)

| **Examples** | **36** | **37** |
|---|---|---|
| **Formulation Components** | | |
| Tungsten & Sulfur-containing compounds | 0.2 | 0.5 |
| Mg and/or Ca sulfonates | 2 | 2 |
| Mg and/or Ca salicylates | 2 | 2 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0.5 | 0.5 |
| Olefin-based polymers (block, star, and/or mixed) | 10 | 10 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.3 | 0.3 |
| Silicone compounds | 0.1 | 0.1 |
| Alkoxylated alcohols | 0 | 1 |
| Group II, III, IV, V base stock and/or mixtures | 78 | 76.7 |
| Group II base stock | 0 | 30 |
| Group III base stock | 31 | 0 |
| Group IV base stock | 42 | 41.7 |
| Group V base stock | 5 | 5 |
| | 100 | 100 |

Fig. 13 (Cont.)

| **Examples** | **38** | **39** |
|---|---|---|
| **Formulation Components** | | |
| Tungsten & Sulfur-containing compounds | 0.5 | 0.5 |
| Mg and/or Ca sulfonates | 1 | 2 |
| Mg and/or Ca salicylates | 2 | 1 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0 | 0 |
| Olefin-based polymers (block, star, and/or mixed) | 10 | 10 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.8 | 0.8 |
| Silicone compounds | 0.1 | 0.1 |
| Alkoxylated alcohols | 0 | 2 |
| Group II, III, IV, V base stock and/or mixtures | 78.7 | 76.7 |
| Group II base stock | 0 | 30 |
| Group III base stock | 31.7 | 0 |
| Group IV base stock | 42 | 41.7 |
| Group V base stock | 5 | 5 |
| | 100 | 100 |

Fig. 13 (Cont.)

| **Examples** | **40** | **41** |
|---|---|---|
| **Formulation Components** | | |
| Tungsten & Sulfur-containing compounds | 0.2 | 0.2 |
| Mg and/or Ca sulfonates | 0 | 0 |
| Mg and/or Ca salicylates | 2 | 0.3 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0.5 | 0.5 |
| Olefin-based polymers (block, star, and/or mixed) | 10 | 10 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.3 | 0.3 |
| Silicone compounds | 0.1 | 0.1 |
| Alkoxylated alcohols | 1 | 1 |
| Group II, III, IV, V base stock and/or mixtures | 79 | 80.7 |
| Group II base stock | 0 | 33.7 |
| Group III base stock | 32 | 0 |
| Group IV base stock | 42 | 42 |
| Group V base stock | 5 | 5 |
| | 100 | 100 |

Fig. 14

| **Examples** | **42** | **43** |
|---|---|---|
| **Formulation Components** | | |
| Tungsten & Sulfur-containing compounds | 0.2 | 0.2 |
| Mg and/or Ca sulfonates | 2 | 2 |
| Mg and/or Ca salicylates | 2 | 2 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0.5 | 0.5 |
| Olefin-based polymers (block, star, and/or mixed) | 15 | 15 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.3 | 0.3 |
| Silicone compounds | 0.1 | 0.1 |
| Alkoxylated alcohols | 1 | 1 |
| Group II, III, IV, V base stock and/or mixtures | 72 | 72 |
| Group II base stock | 0 | 32 |
| Group III base stock | 32 | 0 |
| Group IV base stock | 35 | 35 |
| Group V base stock | 5 | 5 |
| | 100 | 100 |

Fig. 14 (Cont.)

| **Examples** | **44** | **45** |
|---|---|---|
| **Formulation Components** | | |
| Tungsten & Sulfur-containing compounds | 0.2 | 0.2 |
| Mg and/or Ca sulfonates | 1 | 2 |
| Mg and/or Ca salicylates | 2 | 1 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0 | 0 |
| Olefin-based polymers (block, star, and/or mixed) | 15 | 15 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.8 | 0.8 |
| Silicone compounds | 0.1 | 0.1 |
| Alkoxylated alcohols | 2 | 2 |
| Group II, III, IV, V base stock and/or mixtures | 72 | 72 |
| Group II base stock | 0 | 32 |
| Group III base stock | 32 | 0 |
| Group IV base stock | 35 | 35 |
| Group V base stock | 5 | 5 |
| | 100 | 100 |

Fig. 14 (Cont.)

| **Examples** | **46** | **47** |
|---|---|---|
| **Formulation Components** | | |
| Tungsten & Sulfur-containing compounds | 0.2 | 0.5 |
| Mg and/or Ca sulfonates | 2 | 2 |
| Mg and/or Ca salicylates | 2 | 2 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0.5 | 0.5 |
| Olefin-based polymers (block, star, and/or mixed) | 15 | 15 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.3 | 0.3 |
| Silicone compounds | 0.1 | 0.1 |
| Alkoxylated alcohols | 0 | 1 |
| Group II, III, IV, V base stock and/or mixtures | 73 | 71.7 |
| Group II base stock | 0 | 32 |
| Group III base stock | 33 | 0 |
| Group IV base stock | 35 | 34.7 |
| Group V base stock | 5 | 5 |
| | 100 | 100 |

Fig. 14 (Cont.)

| **Examples** | **48** | **49** |
|---|---|---|
| **Formulation Components** | | |
| Tungsten & Sulfur-containing compounds | 0.5 | 0.5 |
| Mg and/or Ca sulfonates | 1 | 2 |
| Mg and/or Ca salicylates | 2 | 1 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0 | 0 |
| Olefin-based polymers (block, star, and/or mixed) | 15 | 15 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.8 | 0.8 |
| Silicone compounds | 0.1 | 0.1 |
| Alkoxylated alcohols | 0 | 2 |
| Group II, III, IV, V base stock and/or mixtures | 73.7 | 71.7 |
| Group II base stock | 0 | 32 |
| Group III base stock | 33.7 | 0 |
| Group IV base stock | 35 | 34.7 |
| Group V base stock | 5 | 5 |
| | 100 | 100 |

Fig. 14 (Cont.)

| **Examples** | **50** | **51** |
|---|---|---|
| **Formulation Components** | | |
| Tungsten & Sulfur-containing compounds | 0.2 | 0.2 |
| Mg and/or Ca sulfonates | 0 | 0 |
| Mg and/or Ca salicylates | 2 | 0.3 |
| Borated and/or non-borated succinimides | 5 | 5 |
| Dialkyl and/or diarylamines | 0.75 | 0.75 |
| Phenolic derivatives | 0.75 | 0.75 |
| Oleic acid derivatives | 0.5 | 0.5 |
| Olefin-based polymers (block, star, and/or mixed) | 15 | 15 |
| Polymethacrylates | 0.3 | 0.3 |
| Fumarate vinyl acetate-based polymers | 0.1 | 0.1 |
| Zinc dialkyl dithiophosphate (1°, 2°, and/or mixed) | 0.3 | 0.3 |
| Silicone compounds | 0.1 | 0.1 |
| Alkoxylated alcohols | 1 | 1 |
| Group II, III, IV, V base stock and/or mixtures | 74 | 75.7 |
| Group II base stock | 0 | 35.7 |
| Group III base stock | 34 | 0 |
| Group IV base stock | 35 | 35 |
| Group V base stock | 5 | 5 |
| | 100 | 100 |

LUBRICATING OIL COMPOSITIONS WITH ENGINE WEAR PROTECTION

FIELD

This disclosure relates to a method for improving wear control, while maintaining or improving deposit control and fuel efficiency, in an engine lubricated with a lubricating oil by including at least one dispersant and a mixture of viscosity modifiers in the lubricating oil. The lubricating oils of this disclosure are useful in internal combustion engines including direct injection, gasoline and diesel engines.

BACKGROUND

Lubricant-related performance characteristics such as high temperature deposit and varnish control, fuel economy and wear protection are extremely advantageous attributes as measured by a variety of bench and engine tests. It is known that selection of viscosity modifier can significantly impact a lubricant formulation's viscosity control over a wide temperature range as well as fuel efficiency. It is also known that addition of viscosity modifiers can also contribute to sludge and deposit formation. Other than viscometric effects, selection of viscosity modifier is not generally expected to have a significant impact on wear performance, while other formulation components, such as ZDDP antiwear and friction modifiers, do.

Therefore, a major challenge in engine oil formulation is simultaneously achieving wear, deposit, and varnish control while also maintaining fuel economy performance, over a broad temperature range.

Lubricant-related wear control is highly desirable due to increasing use of low viscosity engine oils for improved fuel efficiency. As governmental regulations for vehicle fuel consumption and carbon emissions become more stringent, use of low viscosity engine oils to meet the regulatory standards is becoming more prevalent. At the same time, lubricants need to provide a substantial level of durability and wear protection due to the formation of thinner lubricant films during engine operation. As such, use of antiwear additives and friction modifiers in a lubricant formulation is the typical method for achieving wear control and durability. Due to limitations of using high levels of antiwear and friction modifier additives such as catalyst poisoning and deposit formation, it is highly desirable to find alternative methods for achieving excellent wear control and durability.

A major challenge in engine oil formulation is simultaneously achieving high temperature wear control while also maintaining or improving deposit, sludge and varnish control and fuel economy.

Despite the advances in lubricant oil formulation technology, there exists a need for an engine oil lubricant that effectively improves wear control while maintaining or improving deposit control and fuel efficiency.

SUMMARY

This disclosure relates in part to a method for improving wear control, while maintaining or improving deposit control and fuel efficiency, in an engine lubricated with a lubricating oil by including at least one dispersant and a mixture of viscosity modifiers in the lubricating oil. The lubricating oils of this disclosure are useful in internal combustion engines including direct injection, gasoline and diesel engines.

This disclosure also relates in part to a method for improving wear control, while maintaining or improving deposit control and fuel efficiency, in an engine lubricated with a lubricating oil by using as the lubricating oil a formulated oil. The formulated oil has a composition comprising a lubricating oil base stock as a major component, and at least one dispersant and a mixture of viscosity modifiers, as minor components. The at least one dispersant is a polyalkenyl succinic derivative and the at least one viscosity modifier is a vinyl aromatic-containing polymer or copolymer having a weight average molecular weight greater than about 80,000, and a number average molecular weight greater than about 40,000. The vinyl aromatic-containing polymer or copolymer has an amount of vinyl aromatic content greater than about 10% by weight of the vinyl aromatic-containing polymer or copolymer. Wear control is improved and deposit control and fuel efficiency are maintained or improved as compared to wear control, deposit control and fuel efficiency achieved using a lubricating engine oil containing minor components other than the at least one dispersant and the mixture of viscosity modifiers.

This disclosure further relates in part to a lubricating engine oil having a composition comprising a lubricating oil base stock as a major component, and at least one dispersant and a mixture of viscosity modifiers, as minor components. The at least one dispersant is a polyalkenyl succinic derivative and the at least one viscosity modifier is a vinyl aromatic-containing polymer or copolymer having a weight average molecular weight greater than about 80,000, and a number average molecular weight greater than about 40,000. The vinyl aromatic-containing polymer or copolymer has an amount of vinyl aromatic content greater than about 10% by weight of the vinyl aromatic-containing polymer or copolymer. Wear control is improved and deposit control and fuel efficiency are maintained or improved as compared to wear control, deposit control and fuel efficiency achieved using a lubricating engine oil containing minor components other than the at least one dispersant and the mixture of viscosity modifiers.

This disclosure yet further relates in part to a method for improving soot-induced wear control, while maintaining or improving deposit control and fuel efficiency, in a diesel engine lubricated with a lubricating oil by using as the diesel engine lubricating oil a formulated oil. The formulated oil has a composition comprising a lubricating oil base stock as a major component, and at least one dispersant and a mixture of viscosity modifiers, as minor components. The at least one dispersant is a polyalkenyl succinic derivative and the at least one viscosity modifier is a vinyl aromatic-containing polymer or copolymer having a weight average molecular weight greater than about 80,000 and a number average molecular weight greater than about 40,000. The vinyl aromatic-containing polymer or copolymer has an amount of vinyl aromatic content greater than about 10% by weight of the vinyl aromatic-containing polymer or copolymer. Soot-induced wear control is improved and deposit control and fuel efficiency are maintained or improved as compared to soot-induced wear control, deposit control and fuel efficiency achieved using a diesel engine lubricating oil containing minor components other than the at least one dispersant and the mixture of viscosity modifiers.

This disclosure also relates in part to a diesel engine lubricating oil having a composition comprising a lubricating oil base stock as a major component, and at least one dispersant and a mixture of viscosity modifiers, as minor components. The at least one dispersant is a polyalkenyl succinic derivative and the at least one viscosity modifier is a vinyl aromatic-containing polymer or copolymer having a weight average molecular weight greater than about 80,000, and a number average molecular weight greater than about 40,000. The vinyl aromatic-containing polymer or copolymer has an amount of vinyl aromatic content greater than about 10% by weight of the vinyl aromatic-containing polymer or copolymer. Soot-induced wear control is improved and deposit control and fuel efficiency are maintained or improved as compared to soot-induced wear control, deposit control and fuel efficiency achieved using a diesel engine lubricating oil containing minor components other than the at least one dispersant and the mixture of viscosity modifiers.

It has been surprisingly found that, in accordance with this disclosure, improvements in wear control are obtained without sacrificing engine durability (e.g., while maintaining or improving deposit control) and fuel efficiency in an engine lubricated with a lubricating oil, by including at least one dispersant (i.e., a polyalkenyl succinic derivative) and a mixture of viscosity modifiers (i.e., at least one viscosity modifier in the mixture is a vinyl aromatic-containing polymer or copolymer having a weight average molecular weight greater than about 80,000, and a number average molecular weight greater than about 40,000, and the vinyl aromatic-containing polymer or copolymer has an amount of vinyl aromatic content greater than about 10% by weight of the vinyl aromatic-containing polymer or copolymer) in the lubricating oil.

Other objects and advantages of the present disclosure will become apparent from the detailed description that follows.

BRIEF DESCRIPTION OF THE DRAWINGS

FIG. 1 shows comparative formulation embodiments, in particular, individual contributions of components to comparative formulations used in the Examples. Comparative formulation details are shown in weight percent based on the total weight percent of the formulation, of various comparative formulations.

FIG. 2 shows formulation embodiments of this disclosure, in particular, individual contributions of components to formulations used in the Examples. Formulation details are shown in weight percent based on the total weight percent of the formulation, of various formulations.

FIG. 3 shows the results of testing of the comparative formulations described in FIG. 1. The testing includes both bench testing and engine testing.

FIG. 4 shows the results of testing of the formulations described in FIG. 2. The testing includes both bench testing and engine testing.

FIG. 5 shows formulation embodiments of this disclosure and comparative formulation embodiments, in particular, individual contributions of components to formulations and comparative formulations used in the Examples. Formulation and comparative formulation details are shown in weight percent based on the total weight percent of the formulation, of various formulations and comparative formulations.

FIG. 6 shows the results of testing of the formulations and comparative formulations described in FIG. 5. The testing includes both bench testing and engine testing.

FIG. 7 shows the steps, speed, load and time for operating the break-in procedure of the diesel polycyclic endurance test in accordance with the PZD test conducted in the Examples.

FIG. 8 shows the steps, speed, load and time for operating the full load procedure of the diesel polycyclic endurance test in accordance with the PZD test conducted in the Examples.

FIG. 9 shows the steps, speed, load and time for operating the QD mapping procedure of the diesel polycyclic endurance test in accordance with the PZD test conducted in the Examples.

FIG. 10 shows the test cycle (i.e., one cycle of main run) of the diesel polycyclic endurance test in accordance with the PZD test conducted in the Examples. The results of the testing are set forth in FIGS. 3, 4 and 6.

FIG. 11 shows formulation embodiments of this disclosure, in particular, individual contributions of components to the formulations. Formulation details are shown in weight percent based on the total weight percent of the formulation, of various formulations.

FIG. 12 shows formulation embodiments of this disclosure, in particular, individual contributions of components to the formulations. Formulation details are shown in weight percent based on the total weight percent of the formulation, of various formulations.

FIG. 13 shows formulation embodiments of this disclosure, in particular, individual contributions of components to the formulations. Formulation details are shown in weight percent based on the total weight percent of the formulation, of various formulations.

FIG. 14 shows formulation embodiments of this disclosure, in particular, individual contributions of components to the formulations. Formulation details are shown in weight percent based on the total weight percent of the formulation, of various formulations.

DETAILED DESCRIPTION

All numerical values within the detailed description and the claims herein are modified by "about" or "approximately" the indicated value, and take into account experimental error and variations that would be expected by a person having ordinary skill in the art.

It has now been found that improved wear control can be attained, while deposit control and fuel efficiency are unexpectedly maintained or improved, in an engine lubricated with a lubricating oil by using as the lubricating oil a formulated oil that has at least one dispersant (i.e., a polyalkenyl succinic derivative) and a mixture of viscosity modifiers (i.e., at least one viscosity modifier in the mixture is a vinyl aromatic-containing polymer or copolymer having a weight average molecular weight greater than about 80,000, and a number average molecular weight greater than about 40,000, and the vinyl aromatic-containing polymer or copolymer has an amount of vinyl aromatic content greater than about 10% by weight of the vinyl aromatic-containing polymer or copolymer) in the lubricating oil. The formulated oil preferably comprises a lubricating oil base stock as a major component, and at least one dispersant and a mixture of viscosity modifiers, as minor components. The lubricating oils of this disclosure are particularly advantageous as passenger vehicle engine oil (PVEO) products.

The lubricating oils of this disclosure provide excellent engine protection including anti-wear performance. This benefit has been demonstrated for the lubricating oils of this disclosure in the Sequence IVA (ASTM D6891) engine tests. The lubricating oils of this disclosure provide improved fuel efficiency. A lower HTHS viscosity engine oil generally provides superior fuel economy to a higher HTHS viscosity product. This benefit has been demonstrated for the lubricating oils of this disclosure in the PV1451 engine test.

The lubricating engine oils of this disclosure have a composition sufficient to pass wear protection requirements of one or more engine tests selected from Sequence IVA and others.

Lubricating Oil Base Stocks

A wide range of lubricating base oils is known in the art. Lubricating base oils that are useful in the present disclosure are both natural oils, and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org) to create guidelines for lubricant base oils. Group I base stocks have a viscosity index of between about 80 to 120 and contain greater than about 0.03% sulfur and/or less than about 90% saturates. Group II base stocks have a viscosity index of between about 80 to 120, and contain less than or equal to about 0.03% sulfur and greater than or equal to about 90% saturates. Group III stocks have a viscosity index greater than about 120 and contain less than or equal to about 0.03% sulfur and greater than about 90% saturates. Group IV includes polyalphaolefins (PAO). Group V base stock includes base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | polyalphaolefins (PAO) | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked basestocks, including synthetic oils such as polyalphaolefins, alkyl aromatics and synthetic esters are also well known basestock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from about 250 to about 3,000, although PAO's may be made in viscosities up to about 150 cSt (100° C.). The PAOs are typically comprised of relatively low molecular weight hydrogenated polymers or oligomers of alphaolefins which include, but are not limited to, $C_2$ to about $C_{32}$ alphaolefins with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity base stocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt. PAO fluids of particular use may include 3.0 cSt, 3.4 cSt, and/or 3.6 cSt and combinations thereof. Mixtures of PAO fluids having a viscosity range of 1.5 to approximately 150 cSt or more may be used if desired.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

Other useful lubricant oil base stocks include wax isomerate base stocks and base oils, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks and base oils, and other wax isomerate hydroisomerized base stocks and base oils, or mixtures thereof Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, the disclosure of which is incorporated herein by reference in its entirety. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359. Each of the aforementioned patents is incorporated herein in their entirety. Particularly favorable processes are described in European Patent Application Nos. 464546 and 464547, also incorporated herein by reference. Processes using Fischer-Tropsch wax feeds are described in U.S. Pat. Nos. 4,594,172 and 4,943,672, the disclosures of which are incorporated herein by reference in their entirety.

Gas-to-Liquids (GTL) base oils, Fischer-Tropsch wax derived base oils, and other wax-derived hydroisomerized (wax isomerate) base oils be advantageously used in the instant disclosure, and may have useful kinematic viscosities at 100° C. of about 3 cSt to about 50 cSt, preferably about 3 cSt to about 30 cSt, more preferably about 3.5 cSt to about 25 cSt, as exemplified by GTL 4 with kinematic viscosity of about 4.0 cSt at 100° C. and a viscosity index of about 141. These Gas-to-Liquids (GTL) base oils, Fischer-Tropsch wax derived base oils, and other wax-derived hydroisomerized base oils may have useful pour points of about −20° C. or lower, and under some conditions may have advantageous pour points of about −25° C. or lower, with useful pour points of about −30° C. to about −40° C. or lower. Useful compositions of Gas-to-Liquids (GTL) base oils, Fischer-Tropsch wax derived base oils, and wax-derived hydroisomerized base oils are recited in U.S. Pat. Nos. 6,080,301; 6,090,989, and 6,165,949 for example, and are incorporated herein in their entirety by reference.

The hydrocarbyl aromatics can be used as base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of about $C_8$ to about $C_{20}$ often being preferred. A mixture of hydrocarbyl groups is often preferred, and up to about three such substituents may be present. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 3 cSt to about 50 cSt are preferred, with viscosities of approximately 3.4 cSt to about 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be about 2% to about 25%, preferably about 4% to about 20%, and more preferably about 4% to about 15%, depending on the application.

Alkylated aromatics such as the hydrocarbyl aromatics of the present disclosure may be produced by well-known Friedel-Crafts alkylation of aromatic compounds. See Friedel-Crafts and Related Reactions, Olah, G. A. (ed.), Interscience Publishers, New York, 1963. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, New York, 1964. Many homogeneous or heterogeneous, solid catalysts are known to one skilled in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Newer alkylation technology uses zeolites or solid super acids.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms. These esters are widely available commercially, for example, the Mobil P-41 and P-51 esters of ExxonMobil Chemical Company.

Also useful are esters derived from renewable material such as coconut, palm, rapeseed, soy, sunflower and the like. These esters may be monoesters, di-esters, polyol esters, complex esters, or mixtures thereof. These esters are widely available commercially, for example, the Mobil P-51 ester of ExxonMobil Chemical Company.

Engine oil formulations containing renewable esters are included in this disclosure. For such formulations, the renewable content of the ester is typically greater than about 70 weight percent, preferably more than about 80 weight percent and most preferably more than about 90 weight percent.

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of −5° C. to about −40° C. or lower (ASTM D97). They are also characterized typically as having viscosity indices of about 80 to about 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) and hydrodewaxed, or hydroisomerized/cat (and/or solvent) dewaxed base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low sulfur, sulfated ash, and phosphorus (low SAP) products.

Base oils for use in the formulated lubricating oils useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluent/carrier oil for additives used on an "as-received" basis. Even in regard to the Group II stocks, it is preferred that the Group II stock be in the higher quality range associated with that stock, i.e. a Group II stock having a viscosity index in the range 100<VI<120.

The base oil constitutes the major component of the engine oil lubricant composition of the present disclosure and typically is present in an amount ranging from about 50 to about 99 weight percent, preferably from about 70 to about 95 weight percent, and more preferably from about 85 to about 95 weight percent, based on the total weight of the composition. The base oil may be selected from any of the synthetic or natural oils typically used as crankcase lubricating oils for spark-ignited and compression-ignited engines. The base oil conveniently has a kinematic viscosity, according to ASTM standards, of about 2.5 cSt to about 12 cSt (or $mm^2/s$) at 100° C. and preferably of about 2.5 cSt to about 9 cSt (or $mm^2/s$) at 100° C. Mixtures of synthetic and natural base oils may be used if desired. Bi-modal mixtures of Group I, II, III, IV, and/or V base stocks may be used if desired.

Dispersants

During engine operation, oil-insoluble oxidation byproducts are produced. Dispersants help keep these byproducts in solution, thus diminishing their deposition on metal surfaces. Dispersants used in the formulation of the lubricating oil may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the (poly) alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between hydrocarbyl substituted succinic anhydrides and amines. Molar ratios can vary depending on the polyamine. For example, the molar ratio of hydrocarbyl substituted succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs will typically range between 800 and 2,500 or more. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or $HNR_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000, or from about 1000 to about 3000, or about 1000 to about 2000, or a mixture of such hydrocarbylene groups, often with high terminal vinylic groups. Other preferred dispersants include succinic acid-esters and amides, alkylphenol-polyamine-coupled Mannich adducts, their capped derivatives, and other related components.

Polymethacrylate or polyacrylate derivatives are another class of dispersants. These dispersants are typically prepared by reacting a nitrogen containing monomer and a methacrylic or acrylic acid esters containing 5-25 carbon atoms in the ester group. Representative examples are shown in U.S. Pat. Nos. 2,100,993, and 6,323,164. Polymethacrylate and polyacrylate dispersants are normally used as multifunctional viscosity modifiers. The lower molecular weight versions can be used as lubricant dispersants or fuel detergents.

Illustrative preferred dispersants useful in this disclosure include those derived from polyalkenyl-substituted mono- or dicarboxylic acid, anhydride or ester, which dispersant has a polyalkenyl moiety with a number average molecular weight of at least 900 and from greater than 1.3 to 1.7, preferably from greater than 1.3 to 1.6, most preferably from greater than 1.3 to 1.5, functional groups (mono- or dicarboxylic acid producing moieties) per polyalkenyl moiety (a medium functionality dispersant). Functionality (F) can be determined according to the following formula:

$$F=(\mathrm{SAP}\times M_n)/((112{,}200\times \mathrm{A.I.})-(\mathrm{SAP}\times 98))$$

wherein SAP is the saponification number (i.e., the number of milligrams of KOH consumed in the complete neutralization of the acid groups in one gram of the succinic-containing reaction product, as determined according to ASTM D94); $M_n$ is the number average molecular weight of the starting olefin polymer; and A.I. is the percent active ingredient of the succinic-containing reaction product (the remainder being unreacted olefin polymer, succinic anhydride and diluent).

The polyalkenyl moiety of the dispersant may have a number average molecular weight of at least 900, suitably at least 1500, preferably between 1800 and 3000, such as between 2000 and 2800, more preferably from about 2100 to 2500, and most preferably from about 2200 to about 2400. The molecular weight of a dispersant is generally expressed in terms of the molecular weight of the polyalkenyl moiety. This is because the precise molecular weight range of the dispersant depends on numerous parameters including the type of polymer used to derive the dispersant, the number of functional groups, and the type of nucleophilic group employed.

Polymer molecular weight, specifically $M_n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (e.g., ASTM D3592).

The polyalkenyl moiety in a dispersant preferably has a narrow molecular weight distribution (MWD), also referred to as polydispersity, as determined by the ratio of weight average molecular weight ($M_w$) to number average molecular weight ($M_n$). Polymers having a $M_w/M_n$ of less than 2.2, preferably less than 2.0, are most desirable. Suitable polymers have a polydispersity of from about 1.5 to 2.1, preferably from about 1.6 to about 1.8.

Suitable polyalkenes employed in the formation of the dispersants include homopolymers, interpolymers or lower molecular weight hydrocarbons. One family of such polymers comprise polymers of ethylene and/or at least one $C_3$ to $C_2$ alpha-olefin having the formula $H_2C{=}CHR^1$ wherein $R^1$ is a straight or branched chain alkyl radical comprising 1 to 26 carbon atoms and wherein the polymer contains carbon-to-carbon unsaturation, and a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms.

Another useful class of polymers is polymers prepared by cationic polymerization of monomers such as isobutene and styrene. Common polymers from this class include polyisobutenes obtained by polymerization of a $C_4$ refinery stream having a butene content of 35 to 75% by wt., and an isobutene content of 30 to 60% by wt. A preferred source of monomer for making poly-n-butenes is petroleum feedstreams such as Raffinate II. These feedstocks are disclosed in the art such as in U.S. Pat. No. 4,952,739. A preferred embodiment utilizes polyisobutylene prepared from a pure isobutylene stream or a Raffinate I stream to prepare reactive isobutylene polymers with terminal vinylidene olefins. Polyisobutene polymers that may be employed are generally based on a polymer chain of from 1500 to 3000.

The dispersant(s) are preferably non-polymeric (e.g., mono- or bis-succinimides). Such dispersants can be prepared by conventional processes such as disclosed in U.S. Patent Application Publication No. 2008/0020950, the disclosure of which is incorporated herein by reference.

The dispersant(s) can be borated by conventional means, as generally disclosed in U.S. Pat. Nos. 3,087,936, 3,254,025 and 5,430,105.

Such dispersants may be used in an amount of about 0.01 to 20 weight percent or 0.01 to 10 weight percent, preferably about 0.5 to 8 weight percent, or more preferably 0.5 to 6 weight percent. Or such dispersants may be used in an amount of about 2 to 12 weight percent, preferably about 4 to 10 weight percent, or more preferably 6 to 9 weight percent. On an active ingredient basis, such additives may be used in an amount of about 0.06 to 14 weight percent, preferably about 0.3 to 6 weight percent. The hydrocarbon portion of the dispersant atoms can range from $C_{60}$ to $C_{1000}$, or from $C_{70}$ to $C_{300}$, or from $C_{70}$ to $C_{200}$. These dispersants may contain both neutral and basic nitrogen, and mixtures of both. Dispersants can be end-capped by borates and/or cyclic carbonates.

As used herein, the dispersant concentrations are given on an "as delivered" basis. Typically, the active dispersant is delivered with a process oil. The "as delivered" dispersant typically contains from about 20 weight percent to about 80 weight percent, or from about 40 weight percent to about 60 weight percent, of active dispersant in the "as delivered" dispersant product.

Viscosity Modifiers

Viscosity modifiers (also known as viscosity index improvers (VI improvers), and viscosity improvers) can be included in the lubricant compositions of this disclosure.

Viscosity modifiers provide lubricants with high and low temperature operability. These additives impart shear stability at elevated temperatures and acceptable viscosity at low temperatures.

Suitable viscosity modifiers include high molecular weight hydrocarbons, polyesters and viscosity modifier dispersants that function as both a viscosity modifier and a dispersant. Typical molecular weights of these polymers are between about 10,000 to 1,500,000, more typically about 20,000 to 1,200,000, and even more typically between about 50,000 and 1,000,000.

Examples of suitable viscosity modifiers are linear or star-shaped polymers and copolymers of methacrylate, butadiene, olefins, or alkylated styrenes. Polyisobutylene is a commonly used viscosity modifier. Another suitable viscosity modifier is polymethacrylate (copolymers of various chain length alkyl methacrylates, for example), some formulations of which also serve as pour point depressants. Other suitable viscosity modifiers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Hydrogenated polyisoprene star polymers are commercially available from Infineum International Limited, e.g., under the trade designation "SV200" and "SV600". Hydrogenated diene-styrene block copolymers are commercially available from Infineum International Limited, e.g., under the trade designation "SV 50".

The polymethacrylate or polyacrylate polymers can be linear polymers which are available from Evnoik Industries under the trade designation "Viscoplex®" (e.g., Viscoplex 6-954) or star polymers which are available from Lubrizol Corporation under the trade designation Asteric™ (e.g., Lubrizol 87708 and Lubrizol 87725).

Illustrative vinyl aromatic-containing polymers useful in this disclosure may be derived predominantly from vinyl aromatic hydrocarbon monomer. Illustrative vinyl aromatic-containing copolymers useful in this disclosure may be represented by the following general formula:

A-B wherein A is a polymeric block derived predominantly from vinyl aromatic hydrocarbon monomer, and B is a polymeric block derived predominantly from conjugated diene monomer.

The vinyl aromatic-containing polymers or copolymers useful in this disclosure have a weight average molecular weight greater than about 80,000, and a number average molecular weight greater than about 40,000; preferably a weight average molecular weight greater than about 90,000, and a number average molecular weight greater than about 75,000; and more preferably a weight average molecular weight greater than about 100,000 and less than 1,000,000, and a number average molecular weight greater than about 100,000 and less than 1,000,000. The vinyl aromatic-containing polymers or copolymers have an amount of vinyl aromatic content greater than about 10% by weight, or greater than about 20% by weight, or greater than about 30% by weight, of the vinyl aromatic-containing polymer or copolymer. The vinyl aromatic-containing polymers or copolymers have an amount of vinyl aromatic content preferably between about 10% and about 50% by weight, more preferably between about 15% and about 40% by weight, and even more preferably between about 20% and about 35% by weight, of the vinyl aromatic-containing polymer or copolymer.

In an embodiment of this disclosure, the viscosity modifiers may be used in an amount of less than about 2.0 weight percent, preferably less than about 1.0 weight percent, and more preferably less than about 0.5 weight percent, based on the total weight of the formulated oil or lubricating engine oil. Viscosity modifiers are typically added as concentrates, in large amounts of diluent oil.

In another embodiment of this disclosure, the viscosity modifiers may be used in an amount of from 0.05 to about 2.0 weight percent, preferably 0.15 to about 1.0 weight percent, and more preferably 0.25 to about 0.5 weight percent, based on the total weight of the formulated oil or lubricating engine oil. Or the viscosity modifiers may be used in an amount (total solid polymer content) of from 0.5 to about 2.0 weight percent, preferably 0.8 to about 1.5 weight percent, and more preferably 1.0 to about 1.3 weight percent, based on the total weight of the formulated oil or lubricating engine oil.

As used herein, the viscosity modifier concentrations are given on an "as delivered" basis. Typically, the active polymer is delivered with a diluent oil. The "as delivered" viscosity modifier typically contains from 20 weight percent to 75 weight percent of an active polymer for polymethacrylate or polyacrylate polymers, or from 8 weight percent to 20 weight percent of an active polymer for olefin copolymers, hydrogenated polyisoprene star polymers, or hydrogenated diene-styrene block copolymers, in the "as delivered" polymer concentrate.

Other Additives

The formulated lubricating oil useful in the present disclosure may additionally contain one or more of the other commonly used lubricating oil performance additives including but not limited to antiwear agents, other dispersants, detergents, corrosion inhibitors, rust inhibitors, metal deactivators, extreme pressure additives, anti-seizure agents, wax modifiers, other viscosity modifiers, fluid-loss additives, seal compatibility agents, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973); see also U.S. Pat. No. 7,704,930, the disclosure of which is incorporated herein in its entirety. These additives are commonly delivered with varying amounts of diluent oil, that may range from 5 weight percent to 50 weight percent.

The types and quantities of performance additives used in combination with the instant disclosure in lubricant compositions are not limited by the examples shown herein as illustrations.

Antiwear Additive

A metal alkylthiophosphate and more particularly a metal dialkyl dithio phosphate in which the metal constituent is zinc, or zinc dialkyl dithio phosphate (ZDDP) is a useful component of the lubricating oils of this disclosure. ZDDP can be derived from primary alcohols, secondary alcohols or mixtures thereof. ZDDP compounds generally are of the formula $$Zn[SP(S)(OR^1)(OR^2)]_2$$

where $R^1$ and $R^2$ are $C_1$-$C_{18}$ alkyl groups, preferably $C_2$-$C_{12}$ alkyl groups. These alkyl groups may be straight chain or branched. Alcohols used in the ZDDP can be 2-propanol, butanol, secondary butanol, pentanols, hexanols such as 4-methyl-2-pentanol, n-hexanol, n-octanol, 2-ethyl hexanol, alkylated phenols, and the like. Mixtures of secondary alcohols or of primary and secondary alcohol can be preferred. Alkyl aryl groups may also be used.

Preferable zinc dithiophosphates which are commercially available include secondary zinc dithiophosphates such as those available from for example, The Lubrizol Corporation under the trade designations "LZ 677A", "LZ 1095" and "LZ 1371", from for example Chevron Oronite under the trade designation "OLOA 262" and from for example Afton Chemical under the trade designation "HITEC 7169".

The ZDDP is typically used in amounts of from about 0.4 weight percent to about 1.2 weight percent, preferably from about 0.5 weight percent to about 1.0 weight percent, and more preferably from about 0.6 weight percent to about 0.8 weight percent, based on the total weight of the lubricating oil, although more or less can often be used advantageously. Preferably, the ZDDP is a secondary ZDDP and present in an amount of from about 0.6 to 1.0 weight percent of the total weight of the lubricating oil.

Low phosphorus engine oil formulations are included in this disclosure. For such formulations, the phosphorus content is typically less than about 0.12 weight percent preferably less than about 0.10 weight percent and most preferably less than about 0.085 weight percent.

Detergents

Illustrative detergents useful in this disclosure include, for example, alkali metal detergents, alkaline earth metal detergents, or mixtures of one or more alkali metal detergents and one or more alkaline earth metal detergents. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased. These detergents can be used in mixtures of neutral, overbased, highly overbased calcium salicylate, sulfonates, phenates and/or magnesium salicylate, sulfonates, phenates. The TBN ranges can vary from low, medium to high TBN products, including as low as 0 to as high as 600. Mixtures of low, medium, high TBN can be used, along with mixtures of calcium and magnesium metal based detergents, and including sulfonates, phenates, salicylates, and carboxylates. A detergent mixture with a metal ratio of 1, in conjunction of a detergent with a metal ratio of 2, and as high as a detergent with a metal ratio of 5, can be used. Borated detergents can also be used.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$ or mixtures thereof. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched and can be used from 0.5 to 6 weight percent. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

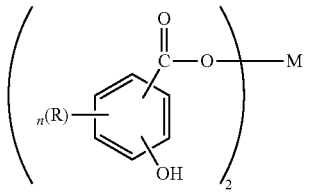

where R is an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents and are known in the art.

Detergents may be simple detergents or what is known as hybrid or complex detergents. The latter detergents can provide the properties of two detergents without the need to blend separate materials. See U.S. Pat. No. 6,034,039.

Preferred detergents include calcium phenates, calcium sulfonates, calcium salicylates, magnesium phenates, magnesium sulfonates, magnesium salicylates and other related components (including borated detergents), and mixtures thereof. Preferred mixtures of detergents include magnesium sulfonate and calcium salicylate, magnesium sulfonate and calcium sulfonate, magnesium sulfonate and calcium phenate, calcium phenate and calcium salicylate, calcium phenate and calcium sulfonate, calcium phenate and magnesium salicylate, calcium phenate and magnesium phenate.

The lubricating oils of this disclosure exhibit desired properties, e.g., wear control, deposit control and fuel efficiency, in the presence or absence of a detergent, in particular, the presence or absence of a salicylate detergent or a sulfonate detergent.

The detergent concentration in the lubricating oils of this disclosure can range from about 0.5 to about 6.0 weight percent, preferably about 0.6 to 5.0 weight percent, and more preferably from about 0.8 weight percent to about 4.0 weight percent, based on the total weight of the lubricating oil.

As used herein, the detergent concentrations are given on an "as delivered" basis. Typically, the active detergent is delivered with a process oil. The "as delivered" detergent typically contains from about 20 weight percent to about 100 weight percent, or from about 40 weight percent to about 60 weight percent, of active detergent in the "as delivered" detergent product.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant disclosure. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants are more fully described in U.S. Pat. No. 8,048,833, herein incorporated by reference in its entirety.

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Preferred antioxidants include hindered phenols, arylamines. These antioxidants may be used individually by type or in combination with one another. Such additives may be used in an amount of about 0.01 to 5 weight percent, preferably about 0.01 to 1.5 weight percent, more preferably zero to less than 1.5 weight percent, more preferably zero to less than 1 weight percent.

Pour Point Depressants (PPDs)

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of about 0.01 to 5 weight percent, preferably about 0.01 to 1.5 weight percent.

Seal Compatibility Agents

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 weight percent, preferably about 0.01 to 2 weight percent.

Antifoam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 weight percent and often less than 0.1 weight percent.

Inhibitors and Antirust Additives

Antirust additives (or corrosion inhibitors) are additives that protect lubricated metal surfaces against chemical attack by water or other contaminants. A wide variety of these are commercially available.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 weight percent, preferably about 0.01 to 1.5 weight percent.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure.

Illustrative friction modifiers may include, for example, organometallic compounds or materials, or mixtures thereof. Illustrative organometallic friction modifiers useful in the lubricating engine oil formulations of this disclosure include, for example, molybdenum amine, molybdenum diamine, an organotungstenate, a molybdenum dithiocarbamate, molybdenum dithiophosphates, molybdenum amine complexes, molybdenum carboxylates, and the like, and mixtures thereof. Similar tungsten based compounds may be preferable.

Other illustrative friction modifiers useful in the lubricating engine oil formulations of this disclosure include, for example, alkoxylated fatty acid esters, alkanolamides, polyol fatty acid esters, borated glycerol fatty acid esters, fatty alcohol ethers, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isosterate, polyoxypropylene isostearate, polyoxyethylene palmitate, and the like.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, polypropoxylated hydrocarbylamides, and the like.

Illustrative polyol fatty acid esters include, for example, glycerol mono-oleate, saturated mono-, di-, and tri-glyceride esters, glycerol mono-stearate, and the like. These can include polyol esters, hydroxyl-containing polyol esters, and the like.

Illustrative borated glycerol fatty acid esters include, for example, borated glycerol mono-oleate, borated saturated mono-, di-, and tri-glyceride esters, borated glycerol monosterate, and the like. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Preferred can be the glycerol monooleates, glycerol dioleates, glycerol trioleates, glycerol monostearates, glycerol distearates, and glycerol tristearates and the corresponding glycerol monopalmitates, glycerol dipalmitates, and glycerol tripalmitates, and the respective isostearates, linoleates, and the like. On occasion the glycerol esters can be preferred as well as mixtures containing any of these. Ethoxylated, propoxylated, butoxylated fatty acid esters of polyols, especially using glycerol as underlying polyol can be preferred.

Illustrative fatty alcohol ethers include, for example, stearyl ether, myristyl ether, and the like. Alcohols, including those that have carbon numbers from $C_3$ to $C_{50}$, can be ethoxylated, propoxylated, or butoxylated to form the corresponding fatty alkyl ethers. The underlying alcohol portion can preferably be stearyl, myristyl, $C_{11}$-$C_{13}$ hydrocarbon, oleyl, isosteryl, and the like.

The lubricating oils of this disclosure exhibit desired properties, e.g., wear control, in the presence or absence of a friction modifier.

Useful concentrations of friction modifiers may range from 0.01 weight percent to 5 weight percent, or about 0.1 weight percent to about 2.5 weight percent, or about 0.1 weight percent to about 1.5 weight percent, or about 0.1 weight percent to about 1 weight percent. Concentrations of molybdenum-containing materials are often described in terms of Mo metal concentration. Advantageous concentrations of Mo may range from 25 ppm to 700 ppm or more, and often with a preferred range of 50-200 ppm. Friction modifiers of all types may be used alone or in mixtures with the materials of this disclosure. Often mixtures of two or more friction modifiers, or mixtures of friction modifier(s) with alternate surface active material(s), are also desirable.

When lubricating oil compositions contain one or more of the additives discussed above, the additive(s) are blended into the composition in an amount sufficient for it to perform its intended function. Typical amounts of such additives useful in the present disclosure are shown in Table 1 below.

It is noted that many of the additives are shipped from the additive manufacturer as a concentrate, containing one or more additives together, with a certain amount of base oil diluents. Accordingly, the weight amounts in the table below, as well as other amounts mentioned herein, are directed to the amount of active ingredient (that is the non-diluent portion of the ingredient). The weight percent (wt %) indicated below is based on the total weight of the lubricating oil composition.

TABLE 1

Typical Amounts of Other Lubricating Oil Components

| Compound | Approximate wt % (Useful) | Approximate wt % (Preferred) |
|---|---|---|
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Modifier (solid polymer basis) | 0.1-2 | 0.1-1 |
| Anti-wear | 0.2-3 | 0.5-1 |
| Inhibitor and Antirust | 0.01-5 | 0.01-1.5 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

The following non-limiting examples are provided to illustrate the disclosure.

EXAMPLES

Formulations were prepared as described in FIGS. 1 and 2. All of the ingredients used herein are commercially available. Group III, IV and V base stocks were used in the formulations. One Group V base stock was an ester base stock and the other Group V base stock was an alkylated naphthalene base stock, as indicated.

The viscosity modifiers used in the formulations were a styrene-isoprene block copolymer (Viscosity Modifier 1) with Mw~100,000 and Mn~100,000, a styrene-isoprene star copolymer (Viscosity Modifier 2) with Mw~660,000 and Mn~600,000, a styrene-isoprene star copolymer (Viscosity Modifier 3) with Mw~100,000 and 1,000,000 and Mn~100,000 and 800,000 respectively, and a polyalkyl methacrylate copolymer (Viscosity Modifier 4) with a KV at 100° C.~1200-1300 cSt.

The dispersants used in the formulations were a polyisobutenyl bis-succinimide partially ethylene-carbonate capped (Dispersant 1) and a polyisobutenyl bis-succinimide uncapped (Dispersant 2).

The detergents used in the formulations were a mixture of salicylate detergents (Detergent 1) and a mixture of overbased magnesium sulfonate, overbased calcium sulfonate, and neutral calcium sulfonate (Detergent 2).

The additive package used in the formulations included conventional additives in conventional amounts. Conventional additives used in the formulations were one or more of a antioxidant, anti-wear agent, pour point depressant, corrosion inhibitor, metal deactivator, seal compatibility additive, anti-foam agent, inhibitor, anti-rust additive, and friction modifier.

PCMO (passenger car motor oil) formulations were prepared. FIGS. 1 and 2 provide formulation details in weight percent based on the total weight percent of the formulation.

Bench testing was conducted for formulations set forth in FIGS. 1 and 2. The results of the bench testing are set forth in FIGS. 3 and 4. The bench testing included the following: kinematic viscosity (KV) at 100° C. measured by ASTM D445, kinematic viscosity (KV) at 100° C. measured by ASTM D445 (base oil only), and kinematic viscosity (KV) at 40° C. measured by ASTM D445. The bench testing also included high temperature high shear (HTHS) viscosity at 150° C. measured by ASTM D4683, and cold cranking simulator (CCS) at −35° C. and −30° C. measured by ASTM D5293.

Engine testing was also conducted for formulations set forth in FIGS. 1 and 2. The results of the engine testing are set forth in FIGS. 3 and 4. The engine testing included a diesel polycyclic endurance test in accordance with a PZD procedure. This procedure consisted of a 6.5-hour engine running-in followed by 500 hours of heavily loaded cyclic operation at wide open throttle. Engine performance checks were conducted at start of test and at 100-hour intervals. The engine oil was changed every 200 hours. Fresh oil was added, as needed, and oil consumption was monitored throughout the test. At test completion, the engine was disassembled and evaluated for engine wear. The test engine was a diesel, V6, 3.0 L with bi-turbocharger and direct-injection fueling system. The engine cooling system was augmented with external pumps and heat exchangers for controlling engine coolant inlet temperature and intercooler coolant outlet temperature.

The testing procedure consisted of three parts, namely break-in, full load and optional QD mapping. The break-in procedure was operated according to the steps, speed, load and time set forth in FIG. 7. The full load procedure was operated according to the steps, speed, load and time set forth in FIG. 8. The QD mapping procedure was operated according to the steps, speed, load and time set forth in FIG. 9. The test cycle (i.e., one cycle of main run) set forth in FIG. 10 was run 170 times for a total test time of 500 hours. Inlet and outlet roller follower clearances were measured both vertically and horizontally at end of test. The results of the testing are set forth in FIGS. 3, 4 and 6.

Engine testing also included a GM Roller Follower Wear Test that measured average pin wear (mils) and was conducted in accordance with ASTM D5966, cleanliness (merits) conducted in accordance with M271 SL, gasoline valve train wear (microns) conducted in accordance with Seq. IVA (ASTM D6891), and fuel economy (% improvement) conducted in accordance with PV1451. The results of this engine testing are set forth in FIGS. 3 and 4.

In FIGS. 3 and 4, the formulation of Comparative Example A versus the formulations of Examples 1, 3-6, 8 and 9 show that addition of a viscosity modifier (i.e., Viscosity Modifier 1, Viscosity Modifier 3 or Viscosity Modifier 4) delivers significantly improved wear protection as measured by the PZD test, up to 95% reduction in wear as measured in the Diesel Polycyclic Endurance Test. FIGS. 3 and 4 show that addition of a viscosity modifier (VM 1 or VM 3 or VM 4) results in a significant and unexpected decrease in wear from 50% to 95%. FIGS. 3 and 4 further describe any combination of VM 1, VM 3 or VM 4 results in an even more significant and unexpected decrease in wear of greater than 80%. Further, FIGS. 3 and 4 show that any combination of VM 1 and VM 3 results in the most significant and unexpected decrease in wear of greater than ~90-95%. Moreover, the formulation of Comparative Example A versus the formulations of Examples 1, 4, 5 and 8 show that addition of a viscosity modifier (i.e., Viscosity Modifier 3) delivers improved wear protection while maintaining good cleanliness and fuel efficiency as measured by the M271 SL and PV1451 tests, respectively. Clear demonstration of the unexpected viscosity modifier benefit is seen when comparing the formulations of Comparative Examples B-I to the formulations of Examples 1-9 in FIGS. 1 and 2, respectively.

FIG. 1 describes a variety of formulations including change type and/or amount of friction modifier, detergent, dispersant, and Group V base stock, resulting in no wear improvement. In contrast, FIG. 2 shows examples of formulations containing viscosity modifier (i.e., Viscosity Modifier 3 and/or Viscosity Modifier 4), or specific combinations of dispersant, detergent and/or viscosity modifier resulting in significant improvement in wear control. Formulations in FIG. 1 show that the unexpected improvement in wear control is seen with a range of ash levels, from approximately 0.6% sulfated ash to approximately 1.0% sulfated ash. Furthermore, FIG. 1 shows the same improvement in wear control with formulations ranging in TBN (total base number) from approximately 6 TBN to approximately 12 TBN. FIGS. 3 and 4 show that addition of a viscosity modifier (VM 1 or VM 3 or VM 4 in combination with Dispersant 1 or 2) results in a significant and unexpected decrease in wear from 50% to 95%. FIGS. 3 and 4 further describe any combination of VM 1, VM 3, VM 4 with Dispersant 2 results in an even more significant and unexpected decrease in wear of greater than 80%. Further, FIGS. 3 and 4 show that any combination of VM 1 and VM 3 and Dispersant 2 results in the most significant and unexpected decrease in wear of greater than ~95%.

In particular, in FIGS. 3 and 4, the formulation of Example 1 shows improvement in wear versus the formulation of Comparative Example A with a change in viscosity modifier (i.e., change to Viscosity Modifier 3) at equivalent viscosity. Also, as shown in FIGS. 3 and 4 with regard to the formulations of Examples 1, 3-6 and 9, further benefit was observed with the combination of Dispersant 2 and use of Viscosity Modifier 3 and/or Viscosity Modifier 4 at equivalent viscosity. Further benefit was observed in the formulation of Example 8 with the combination of Dispersant 2 and use of Viscosity Modifier 3 at reduced viscosity, achieving both reduced wear and increased fuel economy. Further benefit seen with Dispersant 2 is likely due to the larger number of accessible basic nitrogen moieties in comparison to Dispersant 1. The unexpected wear benefit is seen with dispersant basic nitrogen levels greater than 0 to 750 ppm, more preferably from 425 to 625 ppm and most preferably from 500 to 600 ppm. Engine cleanliness and fuel economy performance was maintained across all formulations in FIG. 4.

Additional PCMO (passenger car motor oil) formulations were prepared as detailed in FIG. 5. The formulation ingredients are the same as the formulation ingredients in FIGS. 1 and 2 (except the weight percents based on the total weight percent of the formulation are different).

Bench testing was conducted for formulations set forth in FIG. 5. The results of the bench testing are set forth in FIG. 6. The bench testing included the following: kinematic viscosity (KV) at 100° C. measured by ASTM D445, kinematic viscosity (KV) at 100° C. measured by ASTM D445 (base oil only), and kinematic viscosity (KV) at 40° C. measured by ASTM D445. The bench testing also included high temperature high shear (HTHS) viscosity at 150° C.

measured by ASTM D4683, and cold cranking simulator (CCS) at −35° C. measured by ASTM D5293.

Engine testing was also conducted for formulations set forth in FIG. 5. The results of the engine testing are set forth in FIG. 6. The engine testing included a diesel polycyclic endurance test in accordance with a PZD procedure as described above. Engine testing also included a GM Roller Follower Wear Test that measured average pin wear (mils) and was conducted in accordance with ASTM D5966. The results of this engine testing are set forth in FIG. 6.

In FIG. 6, the formulations of Comparative Examples A, J, K and L versus the formulations of Examples 8, 10 and 11 show that addition of a viscosity modifier (i.e., Viscosity Modifier 3 or Viscosity Modifier 4) delivers significantly improved wear protection as measured by a PZD test of shorter duration than the PZD test conducted in FIGS. 3 and 4. In particular, in FIG. 6, the formulation of Example 10 shows improvement in wear versus the formulation of Comparative Example A with a change in Dispersant 2 at equivalent viscosity. Also, in FIG. 6, the formulation of Example 11 shows improvement in wear versus the formulation of Comparative Example A with the introduction of Viscosity Modifier 4 at equivalent viscosity. FIG. 6 shows that addition of a viscosity modifier (VM 1 or VM 3 or VM 4) results in a significant and unexpected decrease in wear from 50% to 95%. FIG. 6 further describes any combination of VM 1, VM 3, VM 4 results in an even more significant and unexpected decrease in wear of greater than 80%. Further, FIG. 6 shows that any combination of VM 1 and VM 3 results in the most significant and unexpected decrease in wear of greater than ~90-95%. FIG. 6 shows that addition of a viscosity modifier (VM 1 or VM 3 or VM 4 in combination with Dispersant 1 or 2) results in a significant and unexpected decrease in wear from 50% to 95%. FIG. 6 further describes any combination of VM 1, VM 3, VM 4 with Dispersant 2 results in an even more significant and unexpected decrease in wear of greater than 80%. Further, FIG. 6 shows that any combination of VM 1 and VM 3 and Dispersant 2 results in the most significant and unexpected decrease in wear of greater than ~95%.

The lubricating engine oil formulations in FIG. 11 are combinations of additives and base stocks and are anticipated to have a kinematic viscosity at 100° C. around 7 cSt and high temperature high shear ($10^{-6}$ $s^{-1}$) viscosity at 150° C. around 2.3 cP. The lubricating engine oil formulations of Examples 12, 13, 16, 17, 20, and 21 are anticipated to have a phosphorus level around 300 ppm. The lubricating engine oil formulations of Examples 14, 15, 18, 19 are anticipated to have a phosphorus level around 700 ppm. The lubricating engine oil formulations of Examples 20 and 21 are anticipated to have a sulfated ash level around 0.3 weight percent and a total base number around 4. The lubricating engine oil formulations of Examples 12-19 are anticipated to have sulfated ash levels greater than or equal to 1.0 weight percent and total base number greater than or equal to 9. The lubricating engine oil formulations of Examples 20-21 do not contain molybdenum. The lubricating engine oil formulations of Examples 17, 18, 19 are anticipated to have a molybdenum level of around 250 ppm. The lubricating engine oil formulations of Examples 12-16 are anticipated to have molybdenum levels of around 90 ppm. All lubricating engine oil formulations in FIG. 11 that include at least one alkoxylated alcohol are anticipated to provide improvements in fuel economy without sacrificing engine durability (e.g., while maintaining or improving high temperature wear, deposit and varnish control) in an engine lubricated with the lubricating oil formulation.

The lubricating engine oil formulations in FIG. 12 are combinations of additives and base stocks and are anticipated to have a kinematic viscosity at 100° C. around 8 cSt and high temperature high shear ($10^{-6}$ $s^{-1}$) viscosity at 150° C. around 2.7 cP. The lubricating engine oil formulations of Examples 22, 23, 26, 27, 30, and 31 are anticipated to have a phosphorus level around 300 ppm. The lubricating engine oil formulations of Examples 24, 25, 28, 29 are anticipated to have a phosphorus level around 700 ppm. The lubricating engine oil formulations of Examples 30 and 31 are anticipated to have a sulfated ash level around 0.3 weight percent and a total base number around 4. The lubricating engine oil formulations of Examples 22-29 are anticipated to have sulfated ash levels greater than or equal to 1.0 weight percent and total base number greater than or equal to 9. The lubricating engine oil formulations of Examples 30-31 do not contain molybdenum. The lubricating engine oil formulations of Examples 27-29 are anticipated to have a molybdenum level of around 250 ppm. The lubricating engine oil formulations of Examples 22-26 are anticipated to have molybdenum levels of around 90 ppm. All lubricating engine oil formulations in FIG. 12 that include at least one alkoxylated alcohol are anticipated to provide improvements in fuel economy without sacrificing engine durability (e.g., while maintaining or improving high temperature wear, deposit and varnish control) in an engine lubricated with the lubricating oil formulation.

The lubricating engine oil formulations in FIG. 13 are combinations of additives and base stocks and are anticipated to have a kinematic viscosity at 100° C. around 12 cSt and high temperature high shear ($10^{-6}$ $s^{-1}$) viscosity at 150° C. around 3.5 cP. The lubricating engine oil formulations of Examples 32, 33, 36, 37, 40, and 41 are anticipated to have a phosphorus level around 300 ppm. The lubricating engine oil formulations of Examples 34, 35, 38, 39 are anticipated to have a phosphorus level around 700 ppm. The lubricating engine oil formulations of Examples 40 and 41 are anticipated to have a sulfated ash level around 0.3 weight percent and a total base number around 4. The lubricating engine oil formulations of Examples 33-39 are anticipated to have sulfated ash levels greater than or equal to 1.0 weight percent and total base number greater than or equal to 9. The lubricating engine oil formulations of Examples 40 and 41 do not contain molybdenum. The lubricating engine oil formulations of Examples 37-39 are anticipated to have a molybdenum level of around 250 ppm. The lubricating engine oil formulations of Examples 33-36 are anticipated to have molybdenum levels of around 90 ppm. All lubricating engine oil formulations in FIG. 13 that include at least one alkoxylated alcohol are anticipated to provide improvements in fuel economy without sacrificing engine durability (e.g., while maintaining or improving high temperature wear, deposit and varnish control) in an engine lubricated with the lubricating oil formulation.

The lubricating engine oil formulations in FIG. 14 are combinations of additives and base stocks and are anticipated to have a kinematic viscosity at 100° C. around 15 cSt and high temperature high shear ($10^{-6}$ $s^{-1}$) viscosity at 150° C. around 4.0 cP. The lubricating engine oil formulations of Examples 42, 43, 46, 47, 50, and 51 are anticipated to have a phosphorus level around 300 ppm. The lubricating engine oil formulations of Examples 44, 45, 48, 49 are anticipated to have a phosphorus level around 700 ppm. The lubricating engine oil formulations of Examples 50 and 51 are anticipated to have a sulfated ash level around 0.3 weight percent and a total base number around 4. The lubricating engine oil formulations of Examples 42-50 are anticipated to have sulfated ash levels greater than or equal to 1.0 weight percent and total base number greater than or equal to 9. The lubricating engine oil formulations of Examples 50 and 51 do not contain molybdenum. The lubricating engine oil formulations of Examples 47-49 are anticipated to have a molybdenum level of around 250 ppm. The lubricating engine oil formulations of Examples 42-46 are anticipated to have molybdenum levels of around 90 ppm. All lubricating engine oil formulations in FIG. 14 that include at least one alkoxylated alcohol are anticipated to provide improvements in fuel economy without sacrificing engine durability (e.g., while maintaining or improving high temperature wear, deposit and varnish control) in an engine lubricated with the lubricating oil formulation.

PCT and EP Clauses:

1. A method for improving wear control, while maintaining or improving deposit control and fuel efficiency, in an engine lubricated with a lubricating oil by using as the lubricating oil a formulated oil, said formulated oil having a composition comprising a lubricating oil base stock as a major component; and at least one dispersant and a mixture of viscosity modifiers, as minor components; wherein at least one dispersant is a polyalkenyl succinic derivative and at least one viscosity modifier is a vinyl aromatic-containing polymer or copolymer having a weight average molecular weight greater than 80,000, and a number average molecular weight greater than 40,000; wherein the vinyl aromatic-containing polymer or copolymer has an amount of vinyl aromatic content greater than 10% by weight of the vinyl aromatic-containing polymer or copolymer; and wherein wear control is improved and deposit control and fuel efficiency are maintained or improved as compared to wear control, deposit control and fuel efficiency achieved using a lubricating engine oil containing minor components other than the at least one dispersant and the mixture of viscosity modifiers.

2. The method of clause 1 wherein the polyalkenyl succinic derivative is a polyalkenyl succinimide, a polyalkenyl succinate ester, or a polyalkenyl succinate ester amide.

3. The method of clauses 1 and 2 wherein the polyalkenyl succinic derivative is a borated or non-borated polyalkenyl succinimide.

4. The method of clauses 1-3 wherein the vinyl aromatic-containing polymer or copolymer has a weight average molecular weight greater than 90,000, a number average molecular weight greater than 75,000, and an amount of vinyl aromatic content greater than 20% by weight of the vinyl aromatic-containing polymer or copolymer.

5. The method of clauses 1-4 wherein the vinyl aromatic-containing polymer or copolymer is a linear or star-shaped polymer or copolymer, a styrene-isoprene block copolymer or a styrene-isoprene star copolymer.

6. The method of clauses 1-5 wherein the at least one dispersant and the mixture of viscosity modifiers are present in an amount of from 0.01 weight percent to 12.5 weight percent, based on the total weight of the formulated oil.

7. A lubricating engine oil having a composition comprising a lubricating oil base stock as a major component; and at least one dispersant and a mixture of viscosity modifiers, as minor components; wherein at least one dispersant is a polyalkenyl succinic derivative and at least one viscosity modifier is a vinyl aromatic-containing polymer or copolymer having a weight average molecular weight greater than 80,000, and a number average molecular weight greater than 40,000; wherein the vinyl aromatic-containing polymer or copolymer has an amount of vinyl aromatic content greater than 10% by weight of the vinyl aromatic-containing polymer or copolymer; and wherein wear control is improved and deposit control and fuel efficiency are maintained or improved as compared to wear control, deposit control and fuel efficiency achieved using a lubricating engine oil containing minor components other than the at least one dispersant and the mixture of viscosity modifiers.

8. The lubricating engine oil of clause 7 wherein the polyalkenyl succinic derivative is a polyalkenyl succinimide, a polyalkenyl succinate ester, or a polyalkenyl succinate ester amide.

9. The lubricating engine oil of clauses 7 and 8 wherein the polyalkenyl succinic derivative is a borated or non-borated polyalkenyl succinimide.

10. The lubricating engine oil of clauses 7-9 wherein the vinyl aromatic-containing polymer or copolymer has a weight average molecular weight greater than 90,000, a number average molecular weight greater than 75,000, and an amount of vinyl aromatic content greater than 20% by weight of the vinyl aromatic-containing polymer or copolymer.

11. The lubricating engine oil of clauses 7-10 wherein the vinyl aromatic-containing polymer or copolymer is a linear or star-shaped polymer or copolymer, a styrene-isoprene block copolymer or a styrene-isoprene star copolymer.

12. The lubricating engine oil of clauses 7-11 wherein the at least one dispersant and the mixture of viscosity modifiers are present in an amount of from 0.01 weight percent to 12.5 weight percent, based on the total weight of the formulated oil.

13. The lubricating engine oil of clauses 7-12 further comprising one or more of an anti-wear additive, other viscosity modifiers, antioxidant, detergent, other dispersant, pour point depressant, corrosion inhibitor, metal deactivator, seal compatibility additive, anti-foam agent, inhibitor, and anti-rust additive.

14. A method for improving soot-induced wear control, while maintaining or improving deposit control and fuel efficiency, in a diesel engine lubricated with a lubricating oil by using as the diesel engine lubricating oil a formulated oil, said formulated oil having a composition comprising a lubricating oil base stock as a major component; and at least one dispersant and a mixture of viscosity modifiers, as minor components; wherein at least one dispersant is a polyalkenyl succinic derivative and at least one viscosity modifier is a vinyl aromatic-containing polymer or copolymer having a weight average molecular weight greater than 80,000, and a number average molecular weight greater than 40,000; wherein the vinyl aromatic-containing polymer or copolymer has an amount of vinyl aromatic content greater than 10% by weight of the vinyl aromatic-containing polymer or copolymer; and wherein soot-induced wear control is improved and deposit control and fuel efficiency are maintained or improved as compared to soot-induced wear control, deposit control and fuel efficiency achieved using a diesel engine lubricating oil containing minor components other than the at least one dispersant and the mixture of viscosity modifiers.

15. A diesel engine lubricating oil having a composition comprising a lubricating oil base stock as a major component; and at least one dispersant and a mixture of viscosity modifiers, as minor components; wherein at least one dispersant is a polyalkenyl succinic derivative and at least one viscosity modifier is a vinyl aromatic-containing polymer or copolymer having a weight average molecular weight greater than 80,000, and a number average molecular weight greater than 40,000; wherein the vinyl aromatic-containing polymer or copolymer has an amount of vinyl aromatic content greater than 10% by weight of the vinyl aromatic-containing polymer or copolymer; and wherein soot-induced wear control is improved and deposit control and fuel efficiency are maintained or improved as compared to soot-induced wear control, deposit control and fuel efficiency achieved using a diesel engine lubricating oil containing minor components other than the at least one dispersant and the mixture of viscosity modifiers.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A method for improving wear control, while maintaining or improving deposit control and fuel efficiency, in an engine lubricated with a lubricating oil by using as the lubricating oil a formulated oil, said formulated oil having a composition comprising a lubricating oil base stock as a major component; and at least one dispersant and a mixture of viscosity modifiers, as minor components; wherein at least one dispersant is a polyalkenyl succinic derivative and at least two viscosity modifiers, wherein the at least two viscosity modifiers include a vinyl aromatic-containing polymer or copolymer having a weight average molecular weight greater than 80,000, and a number average molecular weight greater than 40,000; wherein the vinyl aromatic-containing polymer or copolymer has an amount of vinyl aromatic content greater than 10% by weight of the vinyl aromatic-containing polymer or copolymer; and wherein wear control is improved and deposit control and fuel efficiency are maintained or improved as compared to wear control, deposit control and fuel efficiency achieved using a lubricating engine oil containing minor components other than the at least one dispersant and the mixture of viscosity modifiers, wherein at least one viscosity modifier is a linear styrene-isoprene block copolymer and at least one viscosity modifier is a bimodal styrene-isoprene star copolymer having a Mw of about 100,000 and about 1,000,000 and a Mn of about 100,000 and about 800,000, wherein the mixture of viscosity modifiers is present in an amount (total solid polymer content) of from 0.5 weight percent to 2.0 weight percent, based on the total weight of the formulated oil.

2. The method of claim 1 wherein the lubricating oil base stock comprises a Group I, Group II, Group III, Group IV or Group V base oil.

3. The method of claim 1 wherein the Group V base oil has a $KV_{100}$ viscosity less than or equal to 5 cSt.

4. The method of claim 1 wherein the polyalkenyl succinic derivative is a polyalkenyl succinimide, a polyalkenyl succinate ester, or a polyalkenyl succinate ester amide.

5. The method of claim 1 wherein the polyalkenyl succinic derivative is a borated or non-borated polyalkenyl succinimide.

6. The method of claim 1 wherein the polyalkenyl succinic derivative is a polyalkenyl mono-succinimide, a polyalkenyl bis-succinimide, or mixtures thereof.

7. The method of claim 1 wherein the vinyl aromatic-containing polymer or copolymer has a weight average molecular weight greater than 90,000, a number average molecular weight greater than 75,000, and an amount of vinyl aromatic content greater than 20% by weight of the vinyl aromatic-containing polymer or copolymer.

8. The method of claim 1 wherein the vinyl aromatic-containing polymer or copolymer has a weight average molecular weight greater than 100,000 and less than 1,000,000, a number average molecular weight greater than 100,000 and less than 1,000,000, and an amount of vinyl aromatic content greater than 30% by weight of the vinyl aromatic-containing polymer or copolymer.

9. The method of claim 1 wherein the linear styrene-isoprene block copolymer has a Mw of about 100,000 and a Mn of about 100,000.

10. The method of claim 1 wherein the vinyl aromatic-containing polymer or copolymer has an amount of vinyl aromatic content between 10% and 50% by weight of the vinyl aromatic-containing polymer or copolymer.

11. The method of claim 1 wherein the at least one dispersant is present in an amount of from 2 weight percent to 12 weight percent, based on the total weight of the formulated oil.

12. The method of claim 1 wherein the at least one dispersant is present in an amount of from 0.01 weight percent to 10 weight percent, based on the total weight of the formulated oil.

13. The method of claim 1 wherein the at least one dispersant and the mixture of viscosity modifiers are present in an amount of from 0.01 weight percent to 12.5 weight percent, based on the total weight of the formulated oil.

14. The method of claim 1 wherein the oil base stock is present in an amount of from 70 weight percent to 95 weight percent, based on the total weight of the formulated oil.

15. The method of claim 1 further comprising one or more of an anti-wear additive, other viscosity modifiers, antioxidant, detergent, other dispersant, pour point depressant, corrosion inhibitor, metal deactivator, seal compatibility additive, anti-foam agent, inhibitor, and anti-rust additive.

16. A lubricating engine oil having a composition comprising a lubricating oil base stock as a major component; and at least one dispersant and a mixture of viscosity modifiers, as minor components; wherein at least one dispersant is a polyalkenyl succinic derivative and at least two viscosity modifiers, wherein the at least two viscosity modifiers include a vinyl aromatic-containing polymer or copolymer having a weight average molecular weight greater than 80,000, and a number average molecular weight greater than 40,000; wherein the vinyl aromatic-containing polymer or copolymer has an amount of vinyl aromatic content greater than 10% by weight of the vinyl aromatic-containing polymer or copolymer; and wherein wear control is improved and deposit control and fuel efficiency are maintained or improved as compared to wear control, deposit control and fuel efficiency achieved using a lubricating engine oil containing minor components other than the at least one dispersant and the mixture of viscosity modifiers, wherein at least one viscosity modifier is a linear styrene-isoprene block copolymer and at least one viscosity modifier is a bimodal styrene-isoprene star copolymer having a Mw of about 100,000 and about 1,000,000 and a Mn of about 100,000 and about 800,000, wherein the mixture of viscosity modifiers is present in an amount (total solid polymer content) of from 0.5 weight percent to 2.0 weight percent, based on the total weight of the formulated oil.

17. The lubricating engine oil of claim 16 wherein the lubricating oil base stock comprises a Group I, Group II, Group III, Group IV or Group V base oil.

18. The lubricating engine oil of claim 16 wherein the Group V base oil has a $KV_{100}$ viscosity less than or equal to 5 cSt.

19. The lubricating engine oil of claim 16 wherein the polyalkenyl succinic derivative is a polyalkenyl succinimide, a polyalkenyl succinate ester, or a polyalkenyl succinate ester amide.

20. The lubricating engine oil of claim 16 wherein the polyalkenyl succinic derivative is a borated or non-borated polyalkenyl succinimide.

21. The lubricating engine oil of claim 16 wherein the polyalkenyl succinic derivative is a polyalkenyl monosuccinimide, a polyalkenyl bis-succinimide, or mixtures thereof.

22. The lubricating engine oil of claim 16 wherein the vinyl aromatic-containing polymer or copolymer has a weight average molecular weight greater than 90,000, a number average molecular weight greater than 75,000, and an amount of vinyl aromatic content greater than 20% by weight of the vinyl aromatic-containing polymer or copolymer.

23. The lubricating engine oil of claim 16 wherein the vinyl aromatic-containing polymer or copolymer has a weight average molecular weight greater than 100,000 and less than 1,000,000, a number average molecular weight greater than 100,000 and less than 1,000,000, and an amount of vinyl aromatic content greater than 30% by weight of the vinyl aromatic-containing polymer or copolymer.

24. The lubricating engine oil of claim 16 wherein the linear styrene-isoprene block copolymer has a Mw of about 100,000 and a Mn of about 100,000.

25. The lubricating engine oil of claim 16 wherein the vinyl aromatic-containing polymer or copolymer has an amount of vinyl aromatic content between 10% and 50% by weight of the vinyl aromatic-containing polymer or copolymer.

26. The lubricating engine oil of claim 16 wherein the at least one dispersant is present in an amount of from 2 weight percent to 12 weight percent, based on the total weight of the formulated oil.

27. The lubricating engine oil of claim 16 wherein the at least one dispersant is present in an amount of from 0.01 weight percent to 10 weight percent, based on the total weight of the formulated oil.

28. The lubricating engine oil of claim 16 wherein the at least one dispersant and the mixture of viscosity modifiers are present in an amount of from 0.01 weight percent to 12.5 weight percent, based on the total weight of the formulated oil.

29. The lubricating engine oil of claim 16 wherein the oil base stock is present in an amount of from 70 weight percent to 95 weight percent, based on the total weight of the formulated oil.

30. The lubricating engine oil of claim 16 further comprising one or more of an anti-wear additive, other viscosity modifier, antioxidant, detergent, other dispersant, pour point depressant, corrosion inhibitor, metal deactivator, seal compatibility additive, anti-foam agent, inhibitor, and anti-rust additive.

31. The lubricating engine oil of claim 16 which is a passenger vehicle engine oil (PVEO).

32. A method for improving soot-induced wear control, while maintaining or improving deposit control and fuel efficiency, in a diesel engine lubricated with a lubricating oil by using as the diesel engine lubricating oil a formulated oil, said formulated oil having a composition comprising a lubricating oil base stock as a major component; and at least one dispersant and a mixture of viscosity modifiers, as minor components; wherein at least one dispersant is a polyalkenyl succinic derivative and at least two viscosity modifiers, wherein the at least two viscosity modifiers include a vinyl aromatic-containing polymer or copolymer having a weight average molecular weight greater than 80,000, and a number average molecular weight greater than 40,000; wherein the vinyl aromatic-containing polymer or copolymer has an amount of vinyl aromatic content greater than 10% by weight of the vinyl aromatic-containing polymer or copolymer; and wherein soot-induced wear control is improved and deposit control and fuel efficiency are maintained or improved as compared to soot-induced wear control, deposit control and fuel efficiency achieved using a diesel engine lubricating oil containing minor components other than the at least one dispersant and the mixture of viscosity modifiers, wherein at least one viscosity modifier is a linear styrene-isoprene block copolymer and at least one viscosity modifier is a bimodal styrene-isoprene star copolymer having a Mw of about 100,000 and about 1,000,000 and a Mn of about 100,000 and about 800,000, wherein the mixture of viscosity modifiers is present in an amount (total solid polymer content) of from 0.5 weight percent to 2.0 weight percent, based on the total weight of the formulated oil.

33. A diesel engine lubricating oil having a composition comprising a lubricating oil base stock as a major component; and at least one dispersant and a mixture of viscosity modifiers, as minor components; wherein at least one dispersant is a polyalkenyl succinic derivative and at least two viscosity modifiers, wherein the at least two viscosity modifiers include is a vinyl aromatic-containing polymer or copolymer having a weight average molecular weight greater than 80,000, and a number average molecular weight greater than 40,000; wherein the vinyl aromatic-containing polymer or copolymer has an amount of vinyl aromatic content greater than 10% by weight of the vinyl aromatic-containing polymer or copolymer; and wherein soot-induced wear control is improved and deposit control and fuel efficiency are maintained or improved as compared to soot-induced wear control, deposit control and fuel efficiency achieved using a diesel engine lubricating oil containing minor components other than the at least one dispersant and the mixture of viscosity modifiers, wherein at least one viscosity modifier is a linear styrene-isoprene block copolymer and at least one viscosity modifier is a bimodal styrene-isoprene star copolymer having a Mw of about 100,000 and about 1,000,000 and a Mn of about 100,000 and about 800,000, wherein the mixture of viscosity modifiers is present in an amount (total solid polymer content) of from 0.5 weight percent to 2.0 weight percent, based on the total weight of the formulated oil.

* * * * *